US012546052B2

(12) United States Patent
Chun et al.

(10) Patent No.: US 12,546,052 B2
(45) Date of Patent: Feb. 10, 2026

(54) WASHING MACHINE

(71) Applicant: SAMSUNG ELECTRONICS CO., LTD., Suwon-si (KR)

(72) Inventors: Kwangmin Chun, Suwon-si (KR); Geonhui Jo, Suwon-si (KR); Bongjin Ko, Suwon-si (KR); Byeongwoo Kim, Suwon-si (KR); Yonggyun Yim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 105 days.

(21) Appl. No.: 18/523,715

(22) Filed: Nov. 29, 2023

(65) Prior Publication Data

US 2024/0254677 A1 Aug. 1, 2024

Related U.S. Application Data

(63) Continuation of application No. PCT/KR2023/017897, filed on Nov. 8, 2023.

(30) Foreign Application Priority Data

Feb. 1, 2023 (KR) ..... 10-2023-0013941

(51) Int. Cl.
*D06F 39/02* (2006.01)
*D06F 34/20* (2020.01)
*D06F 37/30* (2020.01)

(52) U.S. Cl.
CPC ..... *D06F 39/022* (2013.01); *D06F 34/20* (2020.02); *D06F 37/30* (2013.01); *D06F 39/02* (2013.01)

(58) Field of Classification Search
CPC ..... D06F 34/20; D06F 37/30; D06F 39/02; D06F 39/022
See application file for complete search history.

(56) References Cited

U.S. PATENT DOCUMENTS 5,675,994 A 10/1997 Gweon
10,119,217 B2 * 11/2018 Del Pos ..... D06F 34/28
(Continued)

FOREIGN PATENT DOCUMENTS

CN 107142683 A 9/2017
CN 214300847 9/2021
(Continued)

OTHER PUBLICATIONS

International Search Report and Written Opinion of the International Searching Authority dated Feb. 29, 2024, in connection with International Application No. PCT/KR2023/017897, 10 pages.
(Continued)

*Primary Examiner* — Joseph L. Perrin

(57) ABSTRACT

Provided is a washing machine including: a housing; a tub disposed inside the housing; and a detergent supply configured to supply detergent to the tub. The detergent supply includes: a case mounted on the housing; a detergent box configured to be movable in a mounting direction to be mounted on the case and in a separating direction to be separated from the case; a push connection configured to press onto the detergent box in the separating direction; and an electric motor configured to operate the push connection. The push connection is configured to be rotatable between a first position in which the push connection is coupled to the detergent box to support the detergent box in the mounting direction and a second position B in which the push connection is released from the detergent box to release the supporting of the detergent box in the mounting position.

15 Claims, 36 Drawing Sheets

(56) References Cited

U.S. PATENT DOCUMENTS

| | | | | |
|---|---|---|---|---|
| 11,639,575 | B2 | 5/2023 | Jo et al. | |
| 2008/0078211 | A1 | 4/2008 | Je et al. | |
| 2010/0275659 | A1 | 11/2010 | Son et al. | |
| 2014/0137608 | A1 | 5/2014 | Seikel et al. | |
| 2018/0023238 | A1* | 1/2018 | Becchio | D06F 39/022 700/275 |
| 2021/0062399 | A1* | 3/2021 | Li | D06F 39/14 |

FOREIGN PATENT DOCUMENTS

| | | | |
|---|---|---|---|
| CN | 114263028 | A | 4/2022 |
| DE | 10355671 | B4 | 1/2014 |
| JP | 2020525083 | A | 8/2020 |
| KR | 19980027466 | | 8/1998 |
| KR | 100149912 | B1 | 5/1999 |
| KR | 20070063994 | A | 6/2007 |
| KR | 20070088914 | A | 8/2007 |
| KR | 20080030139 | A | 4/2008 |
| KR | 20080055154 | A | 6/2008 |
| KR | 200442445 | Y1 | 11/2008 |
| KR | 20210009650 | A | 1/2021 |
| KR | 20210081880 | A | 7/2021 |

OTHER PUBLICATIONS

Supplementary European Search Report dated Sep. 22, 2025, in connection with European Patent Application No. EP 23920118, 10 pages.

* cited by examiner

WASHING MACHINE

CROSS-REFERENCE TO RELATED APPLICATIONS

This application is a Bypass Continuation of International Application No. PCT/KR2023/017897, filed Nov. 8, 2023, which claims priority to Korean Patent Application No. 10-2023-0013941, filed Feb. 1, 2023, the disclosures of which are herein incorporated by reference in their entirety.

FIELD

The disclosure relates to a washing machine having a detergent supply.

DESCRIPTION OF RELATED ART

A washing machine is a device that uses a driving force of a motor to agitate laundry, washing water, and detergent, which are put into a washing chamber, together, thereby washing the laundry through mutual friction.

A detergent supply is a device that allows a detergent to be evenly mixed with water being supplied in a process of supplying water into a tub of the washing machine.

The detergent supply is installed inside a housing of the washing machine and may include a box-shaped case having an open front, and a detergent box mounted to the inside of the case through the open front of the case and separable in the form of a drawer.

The user may separate the detergent box from the case to refill detergent or clean the detergent box.

One aspect of the disclosure provides a washing machine with a detergent supply that ensures easy mounting and detachment of a detergent box.

One aspect of the disclosure provides a washing machine with a detergent supply that prevents a detergent box from being displaced.

SUMMARY

The technical objectives of the disclosure are not limited to the above, and other objectives that are not described above may become apparent to those of ordinary skill in the art based on the following descriptions.

According to an aspect of the disclosure, there is provided a washing machine including: a housing; a tub disposed inside the housing; and a detergent supply configured to supply detergent to the tub, in which the detergent supply includes: a case mounted on the housing; a detergent box configured to be movable in a mounting direction to be mounted on the case and in a separating direction to be separated from the case; a push connection configured to press onto the detergent box in the separating direction, and an electric motor configured to allow the push connection to operate. The push connection may be configured to be rotatable between a first position in which the push connection is coupled to the detergent box to support the detergent box in the mounting direction and a second position in which the push connection is released from the detergent box to release the supporting of detergent box in the mounting position.

According to an aspect of the disclosure, there is provided a washing machine including: a housing; a tub disposed inside the housing; a case mounted on the housing; a detergent box configured to be movable in a mounting direction to be mounted on the case and in a separating direction to be separated from the case; a push connection coupleable to the detergent box to press on the detergent box in the separating direction; an electric motor configured to operate the push connection; and a control portion configured to control the electric motor. The control portion may be configured to, upon the detergent box being moved in the mounting direction and coupled to the push connection, control the electric motor to move the push connection in the mounting direction.

According to an aspect of the disclosure, there is provided a washing machine including: a housing; a tub disposed inside the housing; and a detergent supply configured to supply detergent to the tub, in which the detergent supply includes: a case formed with an opening; a detergent box configured to be movable in one direction with respect to the case through the opening; and an electric module coupleable to the detergent box for the detergent box to be movable in the one direction. The electric module includes an electric motor and a push connection configured to receive a driving force from the electric motor and move in the one direction. The push connection may include a locking protrusion configured to be inserted into the detergent box and rotatable about an axis in the one direction, to prevent the push connection from being separated from the detergent box.

According to the technical concept of the disclosure, the detergent box can be easily mounted and separated, thereby improving the convenience of use of the washing machine.

According to the technical concept of the disclosure, the detergent box can be prevented from being displaced from the housing, thereby ensuring ease of management.

The effects of the disclosure are not limited to those described above, and other effects not described above will be clearly understood by those skilled in the art from the above detailed description.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
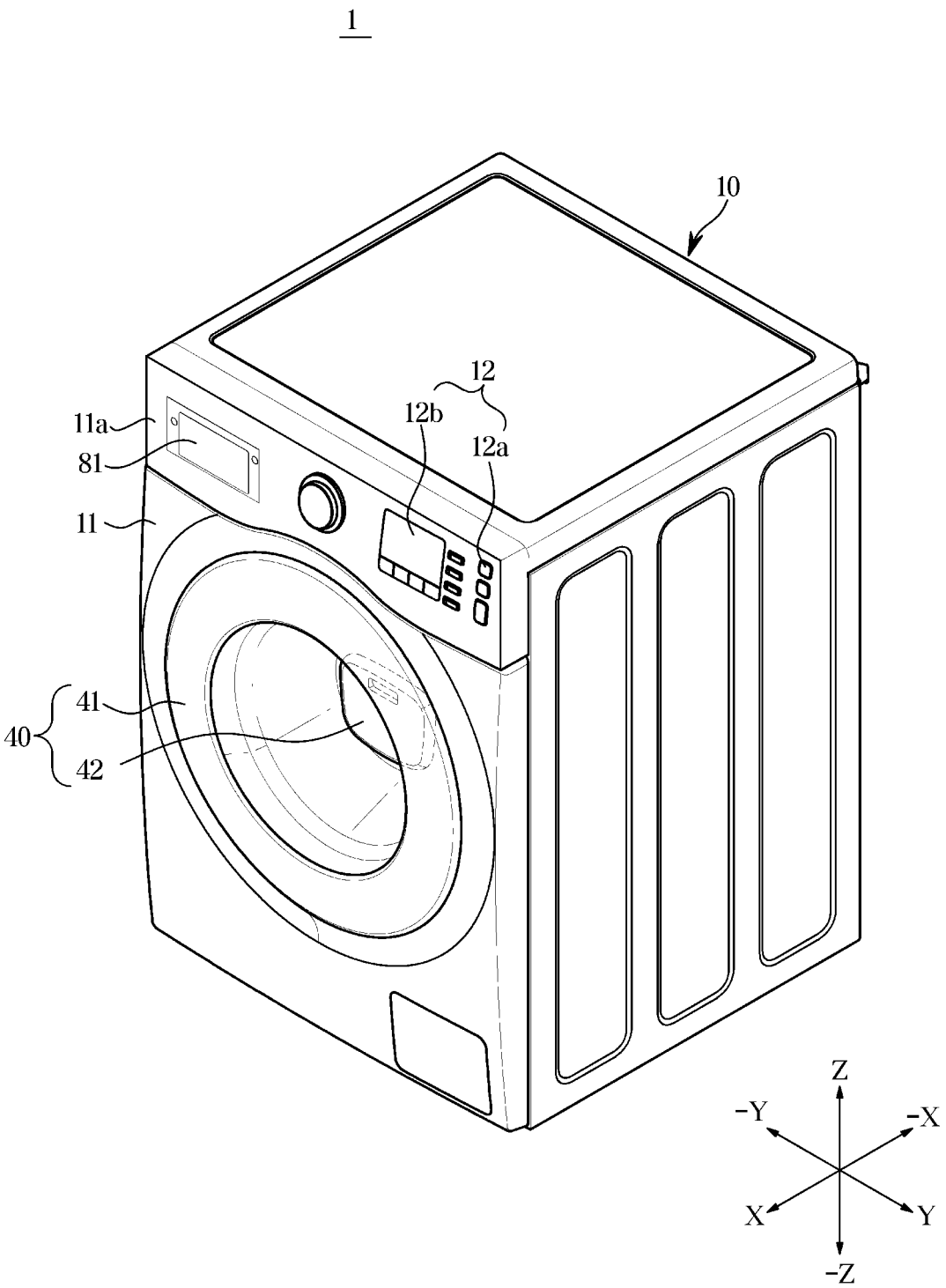
FIG. 1 is a perspective view illustrating a washing machine according to an embodiment of the disclosure.

FIGS. 1 through 36, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The various embodiments of the disclosure and terminology used herein are not intended to limit the technical features of the disclosure to the specific embodiments, but rather should be understood to cover all modifications, equivalents, and alternatives falling within the concept and scope of the disclosure.

In the description of the drawings, like numbers refer to like elements throughout the description of the drawings.

The singular forms preceded by "a," "an," and "the" corresponding to an item are intended to include the plural forms as well unless the context clearly indicates otherwise.

In the disclosure, a phrase such as "A or B," "at least one of A and B," "at least one of A or B," "A, B or C," "at least one of A, B and C," and "at least one of A, B, or C" may include any one of the items listed together in the corresponding phrase of the phrases, or any possible combination thereof.

The term "and/or" includes combinations of one or all of a plurality of associated listed items.

As used herein, such terms as "1st" and "2nd," or "first" and "second" may be used to simply distinguish a corresponding component from another, and does not limit the components in other aspect (for example, importance or order).

When one (e.g., a first) element is referred to as being "coupled" or "connected" to another (e.g., a second) element with or without the term "functionally" or "communicatively," it refers that the one element is connected to the other element directly, wirelessly, or via a third element.

It will be understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

It is to be understood that if a certain component is referred to as being "coupled with," "coupled to," "supported on" or "in contact with" another component, it refers that the component may be coupled with the other component directly or indirectly via a third component.

Throughout the specification, when a member is referred to as being "on" another member, the member is in contact with another member or yet another member is interposed between the two members.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub disposed inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply configured to supply water to the tub. The water supply may include a water supply pipe and a water supply valve disposed in the water supply pipe. The water supply pipe may be connected to an external water supply source. The water supply pipe may extend from an external water supply source to a detergent supply and/or the tub. Water may be supplied to the tub through the detergent supply. Alternatively, water may be supplied to the tub without passing through the detergent supply.

The water supply valve may open or close the water supply pipe in response to an electrical signal of a controller. The water supply valve may allow or block the supply of water to the tub from an external water supply source. The water supply valve may include a solenoid valve configured to open or close in response to an electrical signal.

The washing machine may include the detergent supply configured to supply detergent to the tub. The detergent supply may include a manual detergent supply that requires a user to input detergent to be used for each washing, and an automatic detergent supply that stores a large amount of detergent and automatically inputs a predetermined amount of detergent during washing. The detergent supply may include a detergent box for storing detergent. The detergent supply may be configured to supply detergent into the tub during a water supply process. Water supplied through the water supply pipe may be mixed with detergent via the detergent supply. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drain configured to discharge water contained in the tub to the outside. The drain may include a drain pipe extending from a bottom of the tub to the outside of the housing, a drain valve disposed on the drain pipe to open or close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to one embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to one embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust the rotational speed of the drum or control the water supply valve of the water supply to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter, a washing machine according to various embodiments will be described in detail with reference to the accompanying drawings.

Meanwhile, a detergent box 80 may be mounted to a case 70 in a mounting direction −X and may be separated in a separating direction +X. In the drawings, the mounting direction −X may refer to a direction toward the +X axis, and the separating direction +X may refer to a direction toward the −X axis.

The detergent box 80 may be movable in one direction +X↔−X with respect to the case 70. In other words, the one direction +X↔−X may refer to the mounting direction −X and/or the separating direction +X. In this drawing, the one direction +X↔−X may refer to a direction along the X-axis. The one direction +X↔−X may refer to a front-rear direction.

Figure 2:
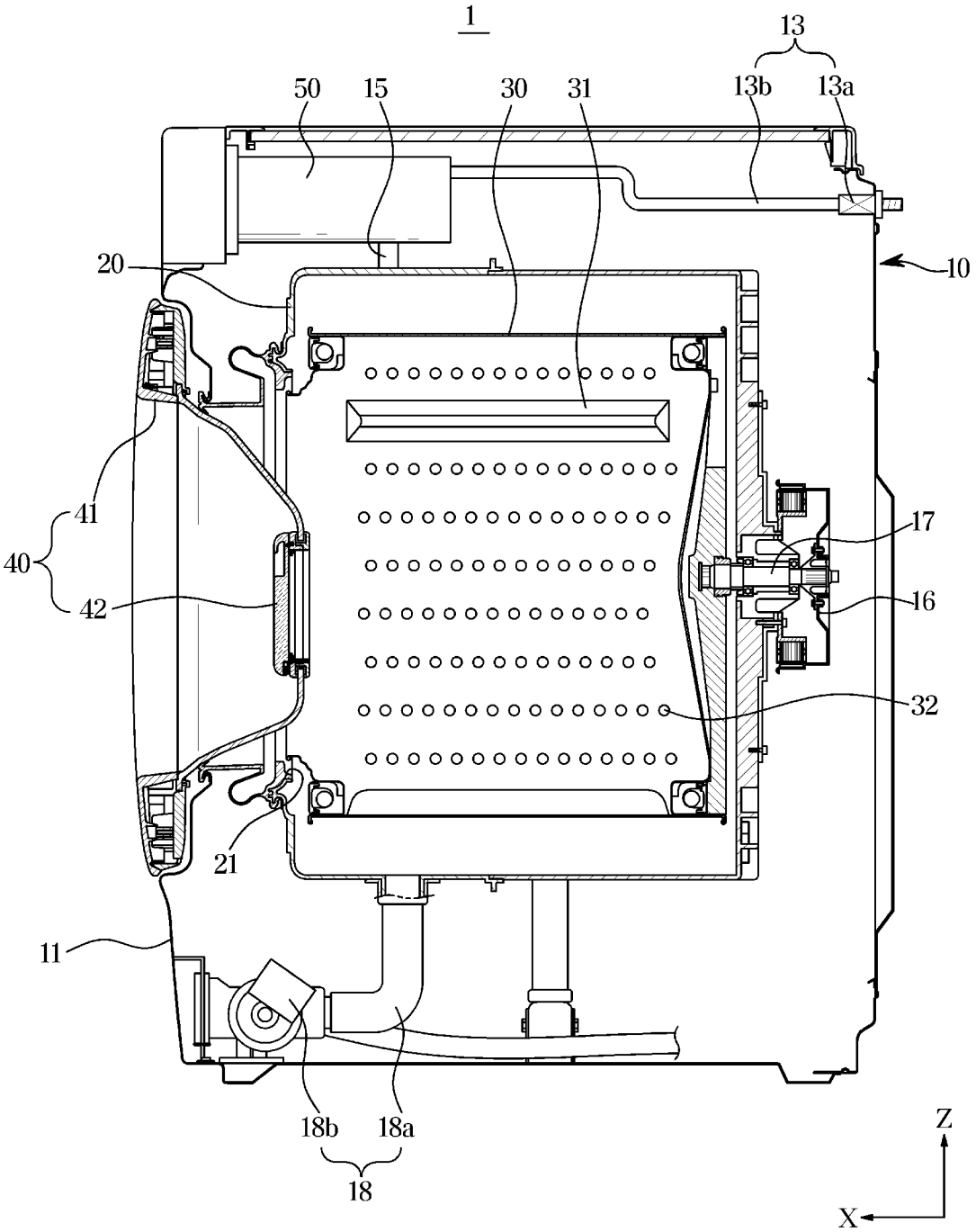
FIG. 2 is a cross-sectional view illustrating a washing machine according to an embodiment of the disclosure.

FIG. 1 is a perspective view illustrating a washing machine according to an embodiment of the disclosure. FIG. 2 is a cross-sectional view illustrating a washing machine according to an embodiment of the disclosure.

A washing machine 1 includes a housing 10 forming the external appearance and accommodating various components therein, a tub 20 provided inside the housing 10 to store washing water, a drum 30 accommodating laundry and rotating, and a drive motor 16 rotating the drum 30.

The housing 10 may have a substantially box shape. The housing 10 may have a front plate 11, a rear plate, a top plate, a bottom plate, and a side plate.

The front plate 11 may be provided with a control panel 12 having an input button 12*a* that receives an operation command from a user and a display 12*b* that displays operation information of the washing machine 1.

The tub 20 may accommodate washing water and may be formed in a substantially cylindrical shape. The tub 20 may be fixed to the inside of the housing 10.

A water supply 13 may be provided on the upper side of the tub 20 to supply washing water into the inside of the tub 20. The water supply 13 may include a water supply pipe 13*b* through which washing water is supplied from an external water supply source, and a water supply valve 13*a* that opens and closes the water supply pipe 13*b*.

A detergent supply 50 that supplies detergent to the tub 20 may be provided in a front upper portion of the housing 10. The detergent supply 50 may be connected to the tub 20 through a connection pipe 15. Washing water supplied through the water supply pipe 13*b* may be supplied to the inside of the tub 20 together with detergent via the detergent supply 50.

A drive motor 16 that generates rotational force to rotate the drum 30 may be provided on the rear side of the tub 20. The drive motor 16 may include a stator in a stationary state and a rotor rotating by electromagnetically interacting with the stator, and may convert electrical force into mechanical rotational force.

The rotational force generated by the drive motor 16 may be transmitted to the drum 30 through a drive shaft 17. The drive shaft 17 may be press-fitted into the rotor of the drive motor 16 and rotated together with the rotor, and may connect the drum 30 and the drive motor 16 by penetrating a rear wall of the tub 20.

A drain 18 may be provided on a lower side of the tub 20 to discharge washing water inside the tub 20 to the outside of the housing 10. The drain 18 may include a drain pipe 18*a* that guides the washing water of the tub 20 to the outside of the housing 10, and a drain pump 18*b* that pumps the washing water of the tub 20.

The drum 30 may have a substantially cylindrical shape with an open front, and may be provided inside the tub 20. The drum 30 may rotate inside the tub 20. The drum 30 may rotate to lift and drop the laundry, thereby performing washing. To this end, a plurality of lifters 31 may be provided on an inner circumferential surface of the drum 30 to lift the laundry when the drum 30 rotates. A plurality of through holes 32 may be formed along the circumference of the drum 30 to allow the washing water stored in the tub 20 to circulate.

The washing machine 1 may include a door assembly 40. The door assembly 40 may include a main door 41 that opens and closes a main inlet of the front plate 11, and an auxiliary door 42 that opens and closes an auxiliary inlet formed in the main door 41. The main door 41 and the auxiliary door 42 may be opened and closed independent of each other.

Figure 3:
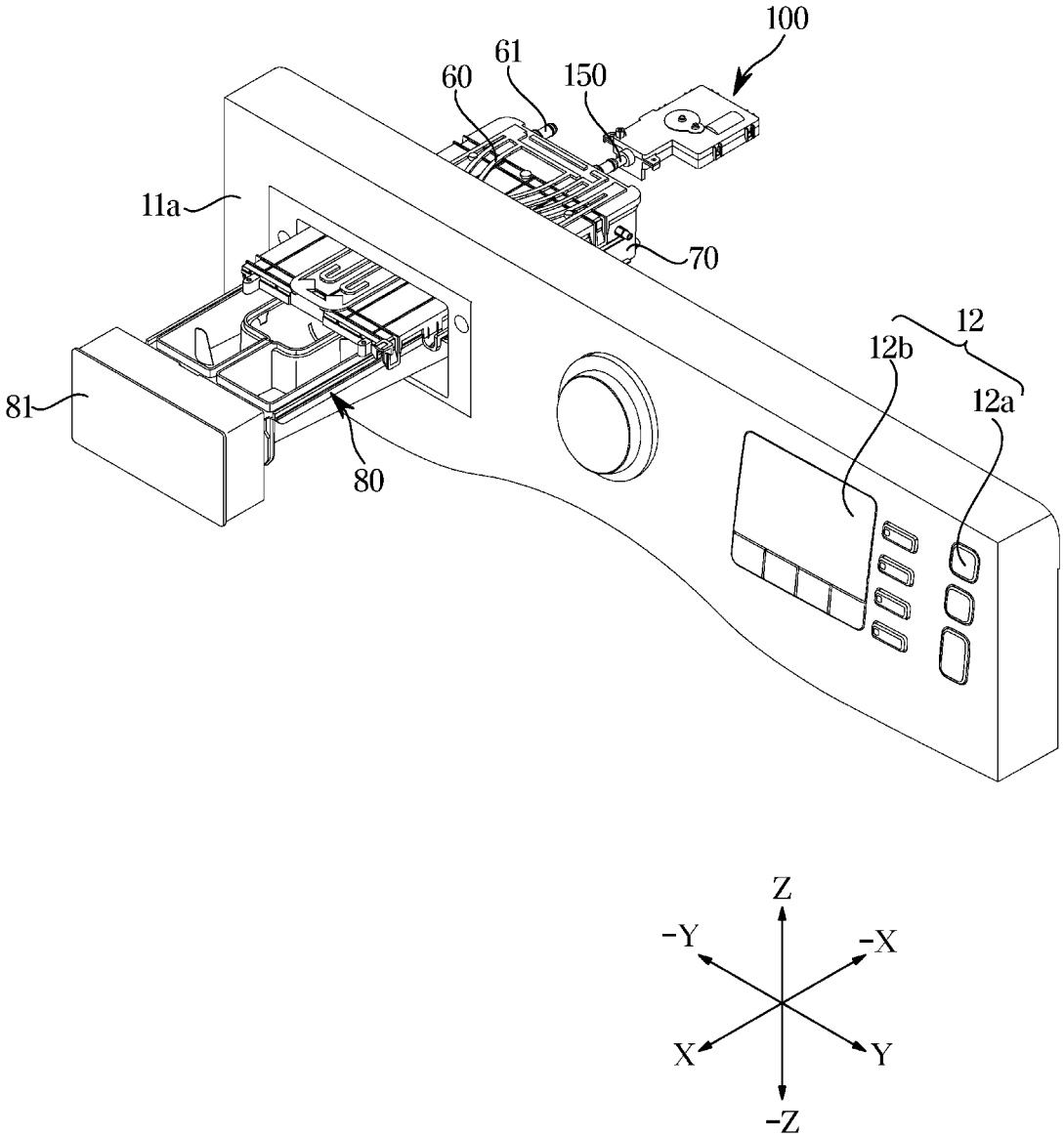
FIG. 3 is a perspective view illustrating a detergent supply mounted to a washing machine according to an embodiment of the disclosure.

FIG. 3 is a perspective view illustrating a detergent supply mounted to a washing machine according to an embodiment of the disclosure.

The detergent supply 50 may be installed inside the housing 10. In the drawings, the detergent supply 50 is illustrated as being disposed on the upper left side in the housing 10, but the disclosure is not limited thereto. For example, the detergent supply 50 may be disposed on the upper right side or on the lower side in the housing 10.

The detergent supply 50 may include a case 70 installed inside the housing 10. The case 70 may be provided to accommodate the detergent box 80. The case 70 may be provided on the upper side of tub 20.

The detergent supply 50 may include the detergent box 80 provided to accommodate detergent. The detergent box 80 may be accommodated inside the case 70.

The detergent box 80 may be mounted to the case 70 toward the mounting direction −X and may be separated from the case 70 toward the separating direction +X. The detergent box 80 may move from the case 70 in one direction +X↔−X. The detergent box 80 may be inserted into and/or withdrawn from the case 70.

The detergent supply 50 may include a water supply unit 60 coupled to the case 70 and/or the detergent box 80 to supply water. The water supply unit 60 may be connected to the water supply pipe 13*b* of the water supply 13. The water supply unit 60 may be provided to cover an upper portion of the case 70.

The detergent supply 50 may include an electric module 100 installed inside the housing 10. The electric module 100 may move the detergent box 80 in the mounting direction −X for the detergent box 80 to be mounted to the case 70. The electric module 100 may move the detergent box 80 in the separating direction +X for the detergent box 80 to be separated from the case 70.

The electric module 100 may include a push connection 150. The push connection 150 may move toward the mounting direction −X and/or the separating direction +X of the detergent box 80. The push connection 150 may press the detergent box 80 in the separating direction +X. The push connection 150 may support the detergent box 80 in the mounting direction −X. The push connection 150 may move along one direction +X↔−X.

The electric module 100 may be provided at the rear of the detergent box 80 and/or the case 70.

The front plate 11 of the washing machine 1 may include a detergent supply installation portion 11*a* formed in at least a portion of the front plate 11 which has been cut out. The detergent supply installation portion 11*a* may be provided in an upper portion of the front plate 11.

The washing machine 1 may include an input interface 300 that receives an operation command from a user. The input interface 300 may include an input button 12*a* provided on the control panel 12.

However, the disclosure is not limited thereto, and the input interface 300 may be provided in various shapes. For example, the input interface 300 may be provided in a form of a touch screen or a dial.

The user may supply detergent to the tub 20 through the input button 12*a*. The user may select an automatic detergent supplymethod or a manual detergent supplymethod.

The user may separate the detergent box 80 from the case 70 through the input button 12*a*. The detergent box 80 may be moved from the case 70 toward the separating direction +X.

The detergent box 80 may be automatically separated from the case 70. That is, rather than the user manually separating the detergent box 80 from the case 70, the detergent box 80 may be automatically separated by a command input by the user. Therefore, the convenience of using the washing machine 1 may be increased.

The detergent box 80 may include a detergent box cover 81 forming the front thereof. The detergent box cover 81 may be a part exposed to the outside even when the detergent box 80 is mounted to the case 70.

The detergent box cover 81 may not include a handle. Since the user does not need to manually pull out the detergent box 80, the detergent box cover 81 may not be provided with a portion to be gripped by the user. Accordingly, the detergent box cover 81 may be provided without a recessed or protruding portion for a handle, and the like.

The detergent box cover 81 may be provided to be flat as a whole. Alternatively, the detergent box cover 81 may be provided with a curved surface as a whole. In other words, since there is no need to provide a portion to be gripped by the user, the degree of freedom in designing the detergent box cover 81 exposed to the outside may be improved, and the aesthetics may be improved.

The detergent box cover 81 may be formed to correspond to the detergent supply installation portion 11*a* of the front plate 11. The detergent box cover 81 may be installed to connect to the front side of the detergent supply installation portion 11*a*. The detergent box cover may be formed to extend along the front plate 11 of the washing machine 1.

Figure 4:
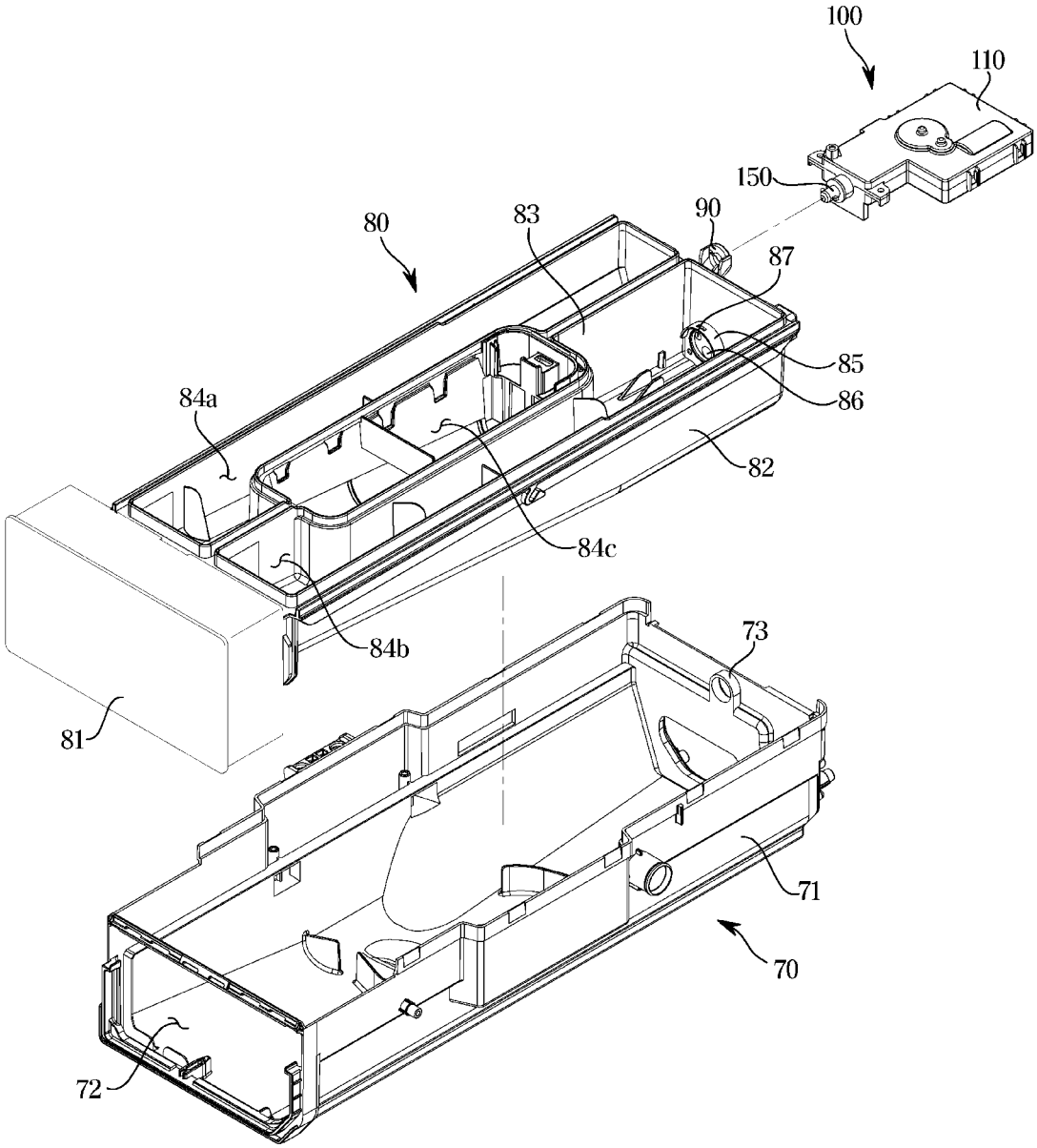
FIG. 4 is an exploded perspective view illustrating some parts of the detergent supply.

FIG. 4 is an exploded perspective view illustrating some parts of the detergent supply.

The case 70 may include a case body 71 in which the detergent box 80 is accommodated, and a case opening 72 formed on the front of the case body 71 and through which the detergent box 80 may be inserted into and/or withdrawn.

The detergent box 80 may be provided to accommodate detergent. The detergent box 80 may be installed to be movable to the inside or outside of the case 70 through the case opening 72.

The detergent box 80 may include a detergent box body 82. The detergent box body 82 may be formed in a box shape with an open top. The inside of the detergent box body 82 may be partitioned by a partition wall 83. The partition wall 83 may be provided in plural.

A detergent accommodating portion 84 may be formed inside the detergent box body 82. Detergent and/or softener may be accommodated in the detergent accommodating portion 84. The detergent accommodating portion 84 may include a first accommodating portion 84*a*, a second accommodating portion 84*b*, and a third accommodating portion 84*c* divided by the partition wall 83.

The detergent box 80 may include a detergent box cover 81 provided on the front of the detergent box body 82. The detergent box cover 81 may be installed to cover the front side of the detergent box body 82. The detergent box cover 81 may be coupled to the detergent box body 82.

The detergent box 80 may include an opening portion 85 provided to supply detergent to a detergent pump (not shown). Detergent accommodated inside the detergent box 80 may be discharged to the detergent pump through the opening portion 85.

The opening portion 85 may include a first open hole 86 into which a detergent suction portion of the detergent pump is inserted and/or a second open hole 87 into which a detergent detecting portion of the detergent pump is inserted.

The electric module 100 may be coupled to the case 70 and/or the detergent box 80. The push connection 150 of the electric module 100 may pass through a case coupling hole 73 formed in the case 70 to be coupled to a detergent box connection 90 of the detergent box 80 disposed inside the case 70.

The case 70 may include the case coupling hole 73 to which the push connection 150 is coupled. The push connection 150 may be inserted into the case coupling hole 73 such that the electric module 100 may be fixed to the case 70.

The detergent box 80 may include the detergent box connection 90. The detergent box connection 90 of the detergent box 80 may be provided at a position corresponding to the case coupling hole 73 of the case 70.

The detergent box connection 90 may be provided such that the detergent box 80 may be coupled to the electric module 100. The detergent box connection 90 may connect the detergent box 80 to the electric module 100. The push connection 150 may be coupled to and/or released from the detergent box 80 by the detergent box connection 90. Details thereof will be described below.

The detergent box connection 90 may be provided at the rear of the detergent box 80. The detergent box connection 90 may be provided to protrude upward from the upper end of the detergent box body 82.

However, the disclosure is not limited thereto, and the detergent box connection 90 may be provided in various shapes at various positions in the detergent box 80 as long as it can be coupled to the electric module 100. For example, the detergent box connection 90 may be provided on the lateral side of the detergent box body 82 or may be provided inside the detergent accommodating portion 84.

Figure 5:
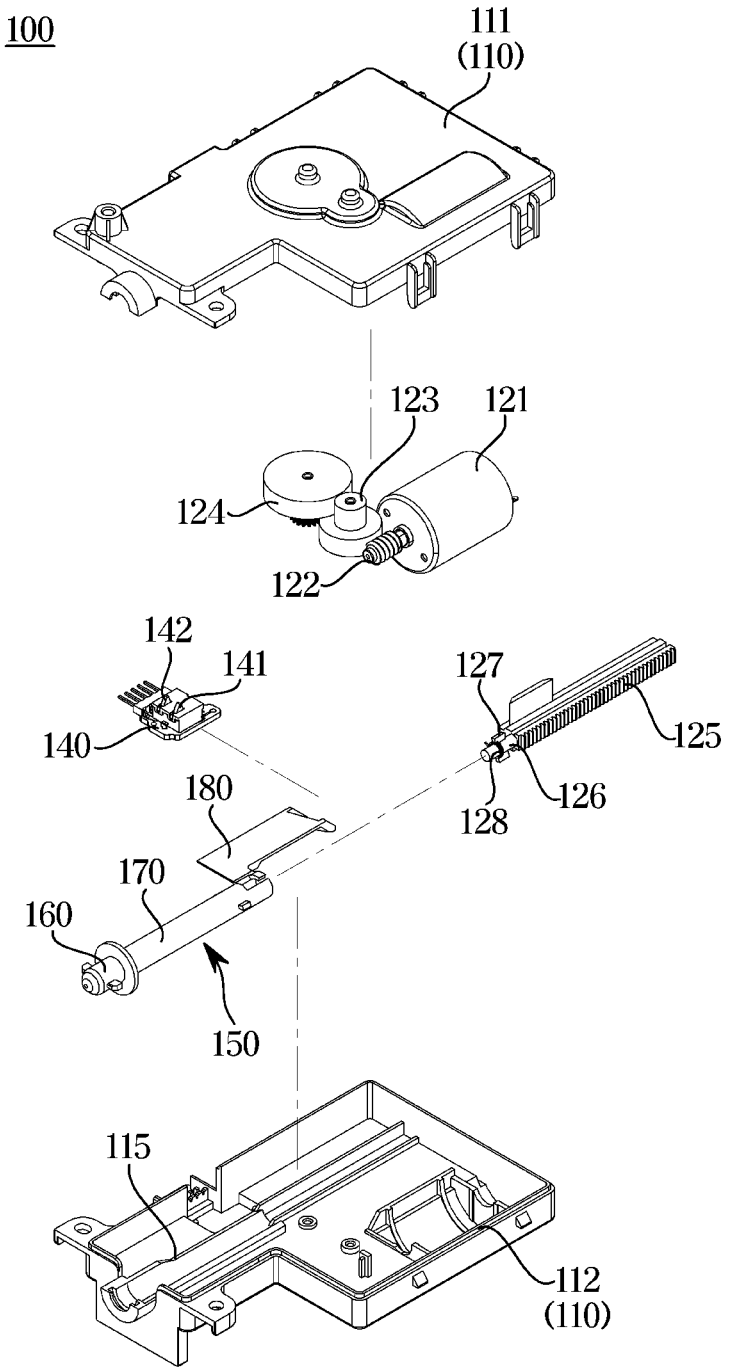
FIG. 5 is an exploded perspective view illustrating a configuration of an electric module according to an embodiment of the disclosure.

FIG. 5 is an exploded perspective view illustrating a configuration of an electric module according to an embodiment of the disclosure.

The electric module 100 may include an electric module case 110. The electric module case 110 may form the external appearance of the electric module 100.

The electric module case 110 may include an electric module upper case 111 and an electric module lower case 112 coupleable to the electric module upper case 111. An accommodating space may be formed between the electric module upper case 111 and the electric module lower case 112. However, the disclosure is not limited thereto, and the electric module case 110 may be formed as one part.

The electric module 100 may include a driving device. The driving device may be provided to transmit driving force to the push connection 150. The push connection 150 may be provided to be moved by receiving driving force from the driving device.

The driving device may include an electric motor 121 that generates power, and a power transmission member that transmits the power of the electric motor 121 to the push connection 150. The electric motor 121 may be rotatably provided.

The power transmission member may include a motor gear 122 that receives driving force from the electric motor 121. The motor gear 122 may be installed on a drive shaft of the electric motor 121.

The power transmission member may include a first transmission gear 123 that receives driving force from the motor gear 122 and a second transmission gear 124 that receives driving force from the first transmission gear 123. The first transmission gear 123 and/or the second transmission gear 124 may include a pinion gear.

Although illustrated that the second transmission gear 124 includes a pinion gear as an example, the disclosure is not limited thereto. The power transmission member may include a single transmission gear. Alternatively, the power transmission member may include three or more transmission gears. The power transmission member may be provided in various ways as long as it can transmit the power generated by the electric motor 121 to the push connection 150.

The power transmission member may include a third transmission gear 125 that provides the driving force transmitted from the first transmission gear 123 and/or the second transmission gear 124 to the push connection 150.

The third transmission gear 125 may include a rack gear. The rack gear of the third transmission gear 125 may be meshed with the pinion gear of the second transmission gear 124.

The third transmission gear 125 may be provided to be linearly movable. The third transmission gear 125 may move along one direction +X↔−X.

The third transmission gear 125 may be disposed at the rear of the push connection 150. The third transmission gear 125 may be disposed at a side toward the mounting direction −X from the push connection 150.

The third transmission gear 125 may provide power to the push connection 150. The push connection 150 and the third transmission gear 125 may be connected to each other. The push connection 150 may move together along the moving direction of the third transmission gear 125. The push connection 150 may linearly move in one direction.

The third transmission gear 125 may include a gear protrusion portion 126 that may be coupled to the push connection 150. The gear protrusion portion 126 may be inserted into the push connection 150.

When the third transmission gear 125 moves along one direction, that is, when the gear protrusion portion 126 moves along one direction +X↔−X, the push connection 150 connected to the gear protrusion portion 126 may also move together with the gear protrusion portion 126. That is, the gear protrusion portion 126 and the push connection 150 may move together along one direction +X↔−X.

A spring 128 may be installed on the gear protrusion portion 126. The spring 128 may be provided to have elastic force. The spring 128 may be installed to wind the outer circumferential surface of the gear protrusion portion 126.

The gear protrusion portion 126 may include a spring support protrusion 127 formed in a protruding manner. The spring support protrusion 127 may protrude in a direction perpendicular to the one direction +X↔−X.

At least a portion of the spring 128 may be supported by the spring support protrusion 127. At least a portion of the spring 128 may be fixed to the gear protrusion portion 126 by the spring support protrusion 127.

The spring 128 may be inserted into the push connection 150 to elastically support the push connection 150. As will be described below, the push connection 150 may rotate about an axis in the one direction +X↔−X. In this case, the spring 128 may apply a reaction force to the push connection 150 in a direction opposite to a direction in which the push connection 150 rotates. Accordingly, the push connection 150 may be re-rotated by the spring 128 to return to the original state.

For example, when the push connection 150 rotates clockwise due to an external force, the spring 128 may apply a counterclockwise reaction force to the push connection 150, and accordingly, the push connection 150 may rotate counterclockwise, returning to the original state.

The electric module 100 may include a switch 140. The switch 140 may be disposed inside the electric module case 110. The switch 140 may be disposed adjacent to the push connection 150. The switch 140 may be disposed on one side of the push connection 150.

The switch 140 may include an inner button 141 disposed adjacent to the push connection 150 and an outer button 142 spaced apart from the inner button 141. The inner button 141 and/or the outer button 142 may be opened and closed by a switch contact 180 of the push connection 150.

The switch 140 may be provided to detect the position of the push connection 150. The push connection 150 may selectively press the switch 140 while moving linearly and/or rotationally.

The switch 140 may be provided to detect the position to which the push connection 150 linearly moves along the one direction +X↔−X and/or the position to which the push connection 150 rotationally moves about an axis in the one direction +X↔−X. The switch 140 may be provided to detect whether the push connection 150 is coupled to the detergent box 80. Details thereof will be described below.

Figure 6:
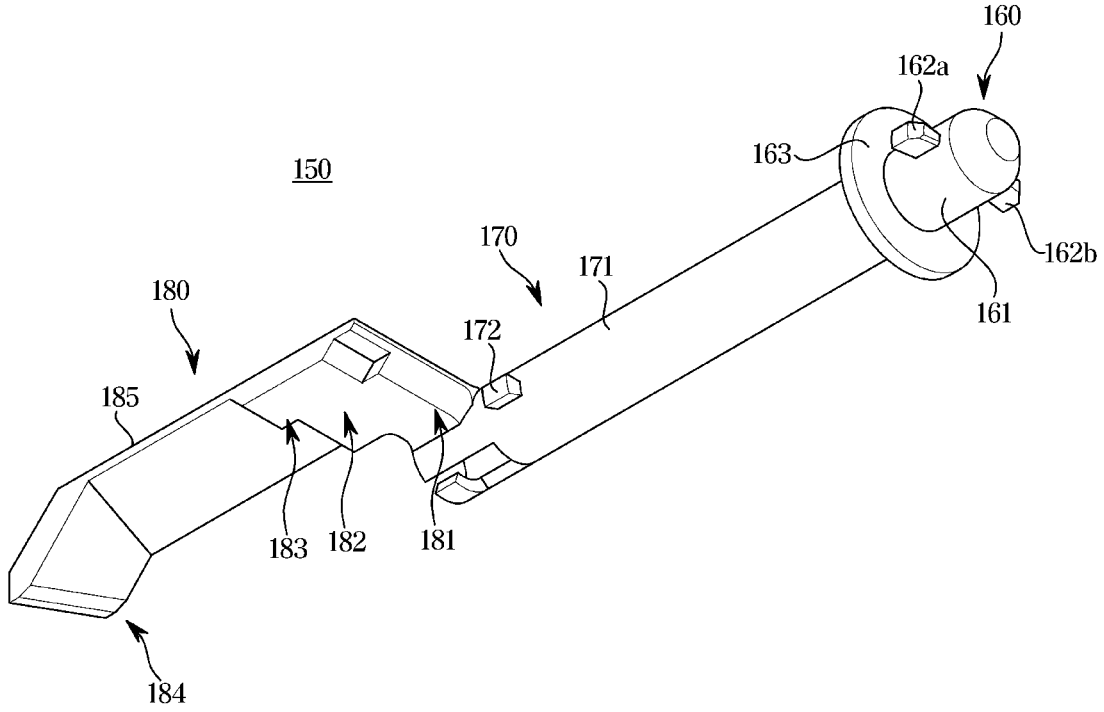
FIG. 6 is a perspective view illustrating a push connection according to an embodiment of the disclosure.
Figure 7:
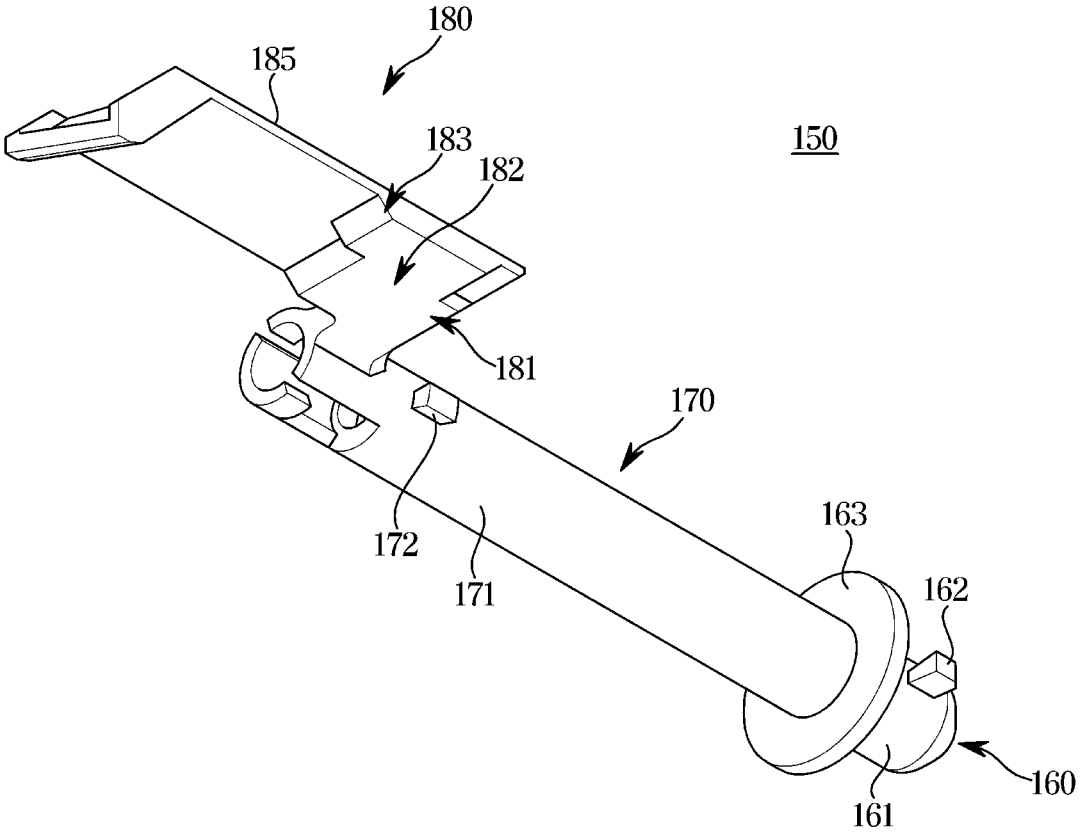
FIG. 7 is a perspective view illustrating a push connection according to an embodiment of the disclosure.

FIG. 6 is a perspective view illustrating a push connection according to an embodiment of the disclosure. FIG. 7 is a perspective view illustrating a push connection according to an embodiment of the disclosure.

The push connection 150 may include a connection 160, a rotating shaft 170, and a switch contact 180. The push connection 150 may be formed as one part.

The push connection 150 may include the connection 160. The connection 160 may be provided to allow the push connection 150 to be coupled to the detergent box 80. The connection 160 may be coupled to the detergent box connection 90 of the detergent box 80.

The connection 160 may be provided at one end of the push connection 150. The one end of the push connection 150 may be disposed adjacent to the detergent box 80. The connection 160 may be provided on the front side of the push connection 150.

The connection 160 may include a header 161 and a locking protrusion 162 protruding from the header 161. The locking protrusion 162 may be supported on the detergent box 80 to prevent the detergent box 80 from being separated from the electric module 100.

The header 161 may extend along one direction +X↔−X. The header 161 may have a cylindrical shape. However, the disclosure is not limited thereto, and the cross-sectional area of the header 161 may be provided in various shapes, such as a circular or quadrangle shape.

The cross-sectional area of the header 161 may be designed to become smaller as being directed forward.

The locking protrusion 162 may protrude from the header 161 in a direction perpendicular to the one direction +X↔−X. The locking protrusion 162 may protrude in a direction perpendicular to the rotation axis +X↔−X of the push connection 150.

The locking protrusion 162 may include a first locking protrusion **162*a* and a second locking protrusion 162*b* spaced apart from the first locking protrusion 162*a*. The first locking protrusion 162*a* and the second locking protrusion 162*b* may be formed at the same position in the one direction +X↔−X. The first locking protrusion 162*a* and the second locking protrusion 162*b* may be formed symmetrical to each other with respect to the rotation axis +X↔−X of the push connection 150**.

However, the disclosure is not limited thereto, and the number of the locking protrusions 162 may be one, or may be three or more.

The push connection 150 may include the rotating shaft 170. The rotating shaft 170 may be provided to rotate the push connection 150. The rotating shaft 170 may guide the push connection 150 to rotate about an axis in one direction +X↔−X while linearly moving along one direction +X↔−X.

The rotating shaft 170 may be connected to the connection 160 and/or the switch contact 180. The rotating shaft 170 may be formed integrally with the connection 160 and/or the switch contact 180. The push connection 150 may be rotated as one body by the rotation of the rotating shaft 170.

The rotating shaft 170 may include a body 171 and a rotating protrusion 172 protruding from the body 171. The rotating protrusion 172 may be provided to guide the rotation of the body 171.

The body 171 may extend along one direction +X↔−X. The body 171 may have a cylindrical shape. However, the disclosure is not limited thereto, and the cross-sectional area of the body 171 may be provided in various shapes such as a circular or quadrangle shape. The body 171 may be provided in the same shape as the header 161.

The rotating protrusion 172 may protrude from the body 171 in a direction perpendicular to one direction +X↔−X. The rotating protrusion 172 may protrude in a direction perpendicular to the rotation axis +X↔−X of the push connection 150.

The rotating protrusion 172 may be provided on one side of the push connection 150. Although the rotating protrusion 172 is illustrated as one unit, the disclosure is not limited thereto. For example, the rotating protrusion 172 may be provided in two or more units.

The push connection 150 may include an intermediate plate 163 disposed between the header 161 and the body 171. The intermediate plate 163 may connect the header 161 and the body 171. The intermediate plate 163 may be formed to have a cross-sectional area larger than that of the header 161 and/or the body 171.

The push connection 150 may include the switch contact 180. The switch contact 180 may be provided to press the switch 140. The switch contact 180 may be provided to selectively press the switch 140 according to the linear movement and/or rotational movement of the push connection 150.

The switch contact 180 may be provided at the other end of the push connection 150 from the connection 160. The switch contact 180 may be formed at a side opposite to the connection 160. The switch contact 180 may be provided at the rear of the push connection 150.

The switch contact 180 may include a wing 185. The wing 185 may protrude from the body 171 toward one side of the switch contact 180. The wing 185 may protrude from the body 171 toward the switch 140.

The switch contact 180 may include a first pressing portion 181, a second pressing portion 182, a third pressing portion 183, and a fourth pressing portion 184. The first pressing portion 181 may be provided to close the inner button 141 and open the outer button 142 of the switch 140. The second pressing portion 182 may be provided to close both the inner button 141 and the outer button 142. The third pressing portion 183 may be provided to open the inner button 141 and close the outer button 142. The fourth pressing portion 184 may be provided to close both the inner button 141 and the outer button 142. Details thereof will be described below.

Figure 8:
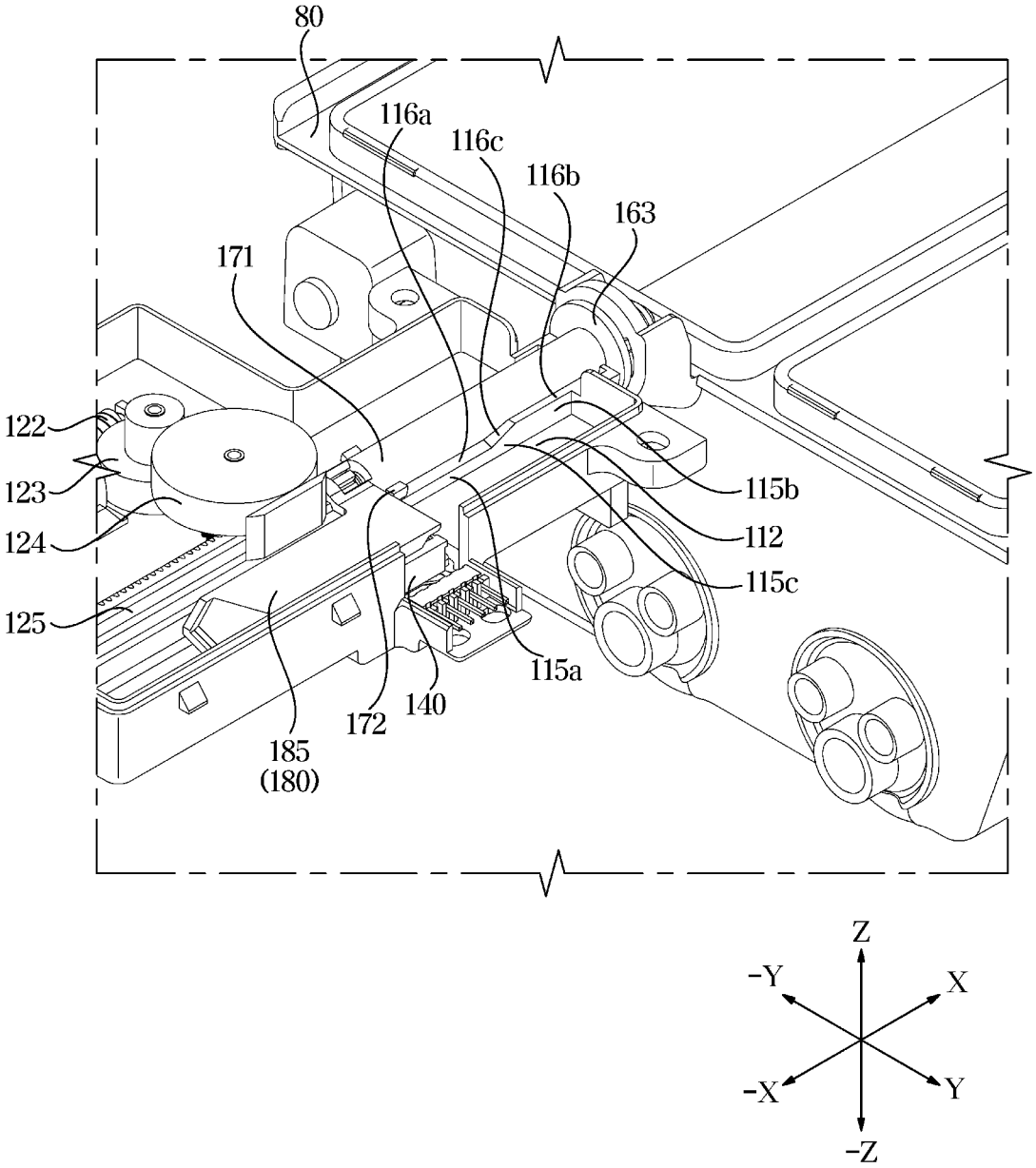
FIG. 8 is a view illustrating a state in which a push connection is located in a first pressing position according to an embodiment of the disclosure.
Figure 9:
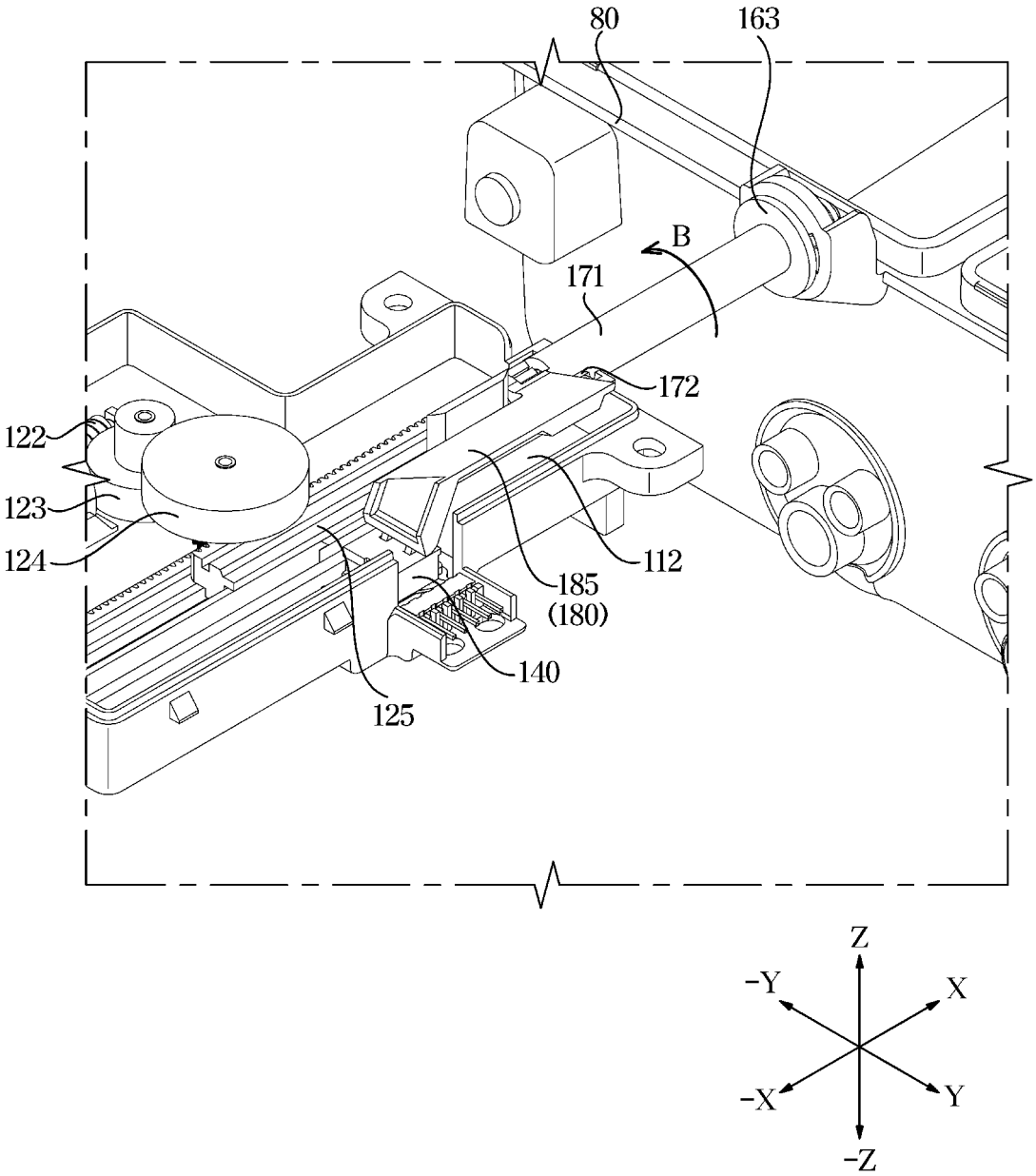
FIG. 9 is a view illustrating a state in which the push connection is moved to a second pressing position from the position in FIG. 8.

FIG. 8 is a view illustrating a state in which a push connection is located in a first pressing position according to an embodiment of the disclosure. FIG. 9 is a view illustrating a state in which the push connection is moved to a second pressing position from the position in FIG. 8.

Referring to FIG. 8, the push connection 150 may be located in a first pressing position. The first pressing position may be a position in which the push connection 150 is disposed at the rearmost position in one direction +X↔−X during the operation of the electric module 100. The first pressing position may be a position to which the push connection 150 is maximally movable in the mounting direction −X inside the electric module case 110.

In the first pressing position, the push connection 150 may be in a state of being coupled to the detergent box 80. In the first pressing position, the locking protrusion 162 of the push connection 150 may be in a first position A in which the locking protrusion 162 is supported by the detergent box 80.

Referring to FIG. 9, the push connection 150 may be located in a second pressing position. The second pressing position may be a position in which the push connection 150 is disposed at the foremost position in one direction +X↔−X during the operation of the electric module 100. The second pressing position may be a position to which the push connection 150 is maximally movable in the separating direction +X inside the electric module case 110.

The push connection 150 may be moved from the first pressing position in the separating direction +X into the second pressing position.

In the second pressing position, the push connection 150 may be released from the detergent box 80. In the second pressing position, the locking protrusion 162 of the push connection 150 may be rotated to a second position B.

That is, the push connection 150 may move along the one direction +X↔−X from the first pressing position toward the second pressing position while rotating about an axis in the one direction +X↔−X. Referring to the drawing, the push connection 150 may move forward while rotating counterclockwise.

The electric module 100 may include a rotation guide provided to rotate the push connection 150. The rotation guide may guide the push connection 150 to rotate about an axis in the one direction +X↔−X while moving linearly along the one direction +X↔−X.

The rotation guide may include a guide wall 115. The guide wall 115 may be provided in the electric module case 110. The guide wall 115 may be provided in the electric module lower case 112. The guide wall 115 may be formed to protrude from an upper surface of the electric module lower case 112 toward a lower surface of the electric module upper case 111.

The guide wall 115 may support the push connection 150 such that the push connection 150 is seated inside the electric module case 110. The guide wall 115 may accommodate the push connection 150 to prevent the push connection 150 from being separated from the inside of the electric module case 110 when the push connection 150 moves. The guide wall 115 may be disposed on one side of the push connection 150.

The guide wall 115 may include a rear guide wall 115*a*, a middle guide wall 115*c*, and a front guide wall 115*b*.

The rear guide wall 115*a* may be an area disposed at the rear of the guide wall 115. The front guide wall 115*b* may be an area disposed at the front of the guide wall 115. The middle guide wall 115*c* may be an area disposed between the rear guide wall 115*a* and the front guide wall 115*b*.

The guide wall 115 may include a contact surface 116. The contact surface 116 may form an upper surface of the guide wall 115. The contact surface 116 may be a surface facing upward. The contact surface 116 may face the lower surface of the electric module upper case 111.

The contact surface 116 may be provided to seat the rotating protrusion 172 of the push connection 150 thereon. The contact surface 116 may be provided to support the rotating protrusion 172. The contact surface 116 may be provided to contact the rotating protrusion 172. The contact surface 116 may contact a lower surface of the rotating protrusion 172.

The push connection 150 may move along one direction +X↔−X while the rotating protrusion 172 is in contact with the contact surface 116.

The rear guide wall 115*a* may include a first contact surface 116*a*. The front guide wall 115*b* may include a second contact surface 116*b*. When the push connection 150 is in the first pressing position, the rotating protrusion 172 may contact the first contact surface 116*a* of the rear guide wall 115*a*. When the push connection 150 is in the second pressing position, the rotating protrusion 172 may contact the second contact surface 116*b* of the front guide wall 115*b*.

The height of the guide wall 115 may be provided to differ in one direction +X↔−X. The height of the guide wall 115 may refer to the length protruding from the electric module lower case 112 toward the electric module upper case 111.

The height of the second contact surface 116*b* may be different from the height of the first contact surface 116*a*. The height of the second contact surface 116*b* may be provided to be higher than the height of the first contact surface 116*a*.

A contact surface 116*c* of the middle guide wall 115*c* may be inclined. The contact surface 116*c* of the middle guide wall 115*c* may be provided to slope upward toward the front.

Since the height of the contact surface 116 increases as being directed forward, the rotating protrusion 172 moving forward may be rotated by the contact surface 116. That is, the push connection 150, while moving forward, rotates counterclockwise by the rotation guide. The push connection 150 may be rotated from the first position A in which the push connection 150 is coupled to the detergent box 80 to the second position B in which the push connection 150 is released from the detergent box 80.

Figure 10:
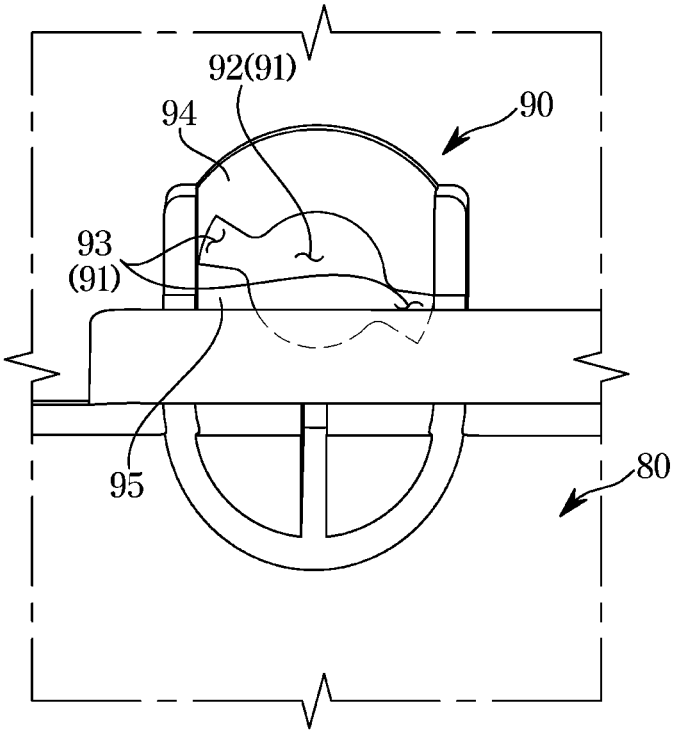
FIG. 10 is a view illustrating a detergent box connection according to an embodiment of the disclosure.
Figure 11:
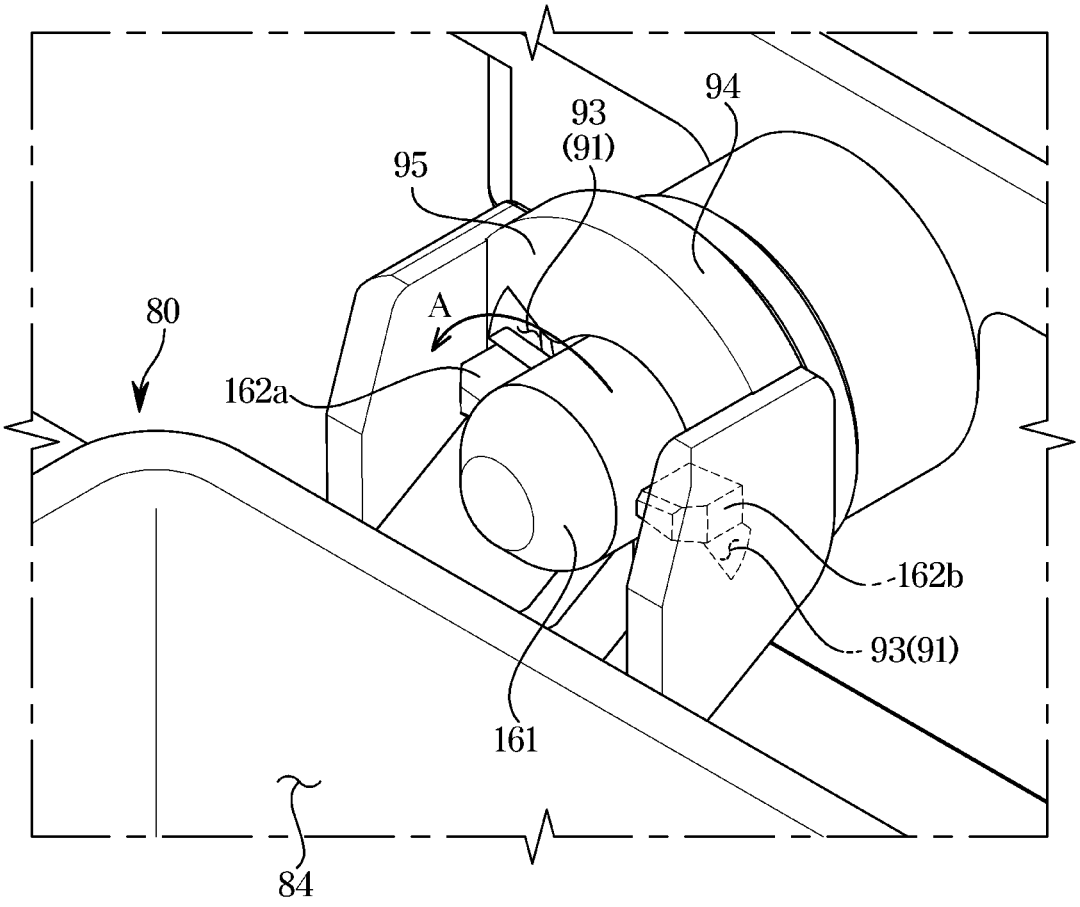
FIG. 11 is a view illustrating a state in which a push connection is coupled to a detergent box while in in a first position according to an embodiment of the disclosure.
Figure 12:
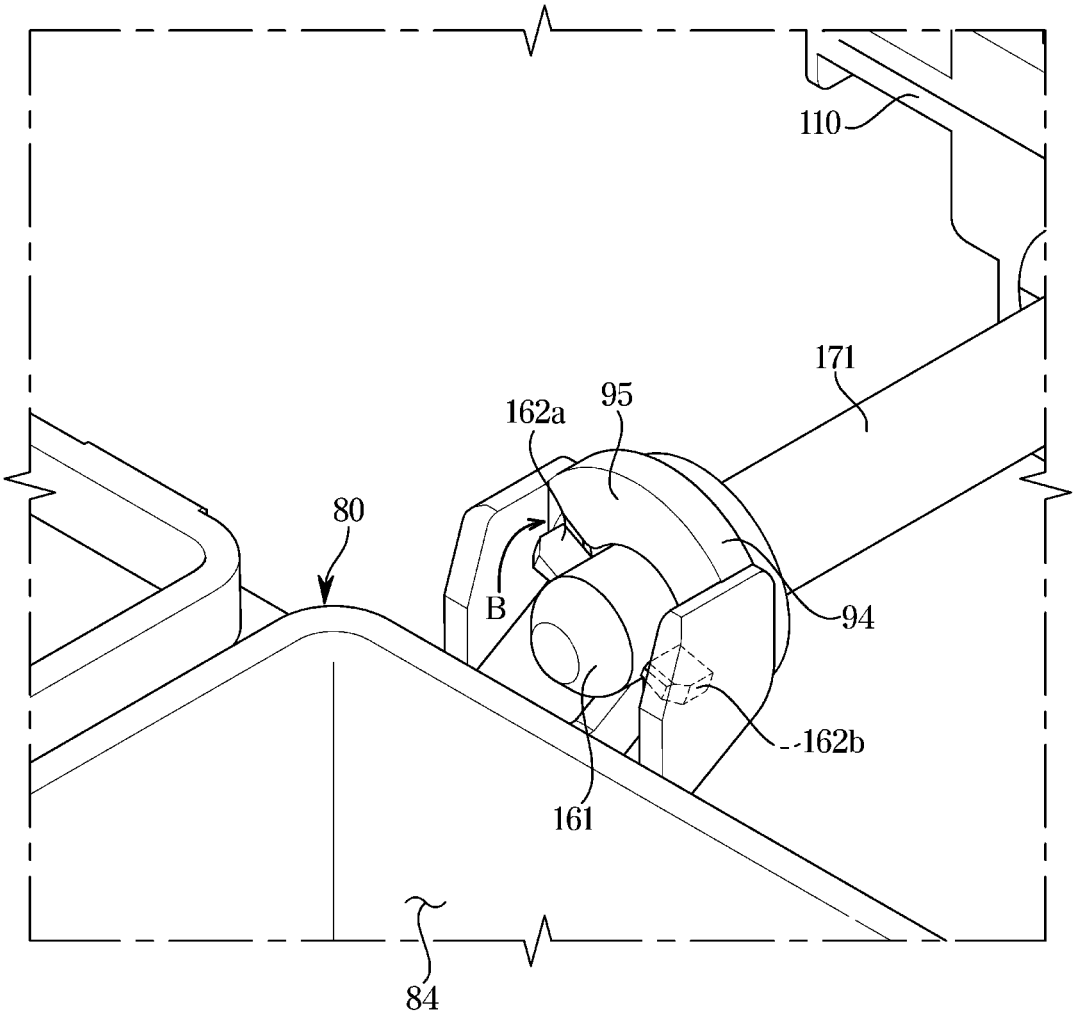
FIG. 12 is a view illustrating a state in which a push connection is released from a detergent box while in a second position according to an embodiment of the disclosure.
Figure 13:
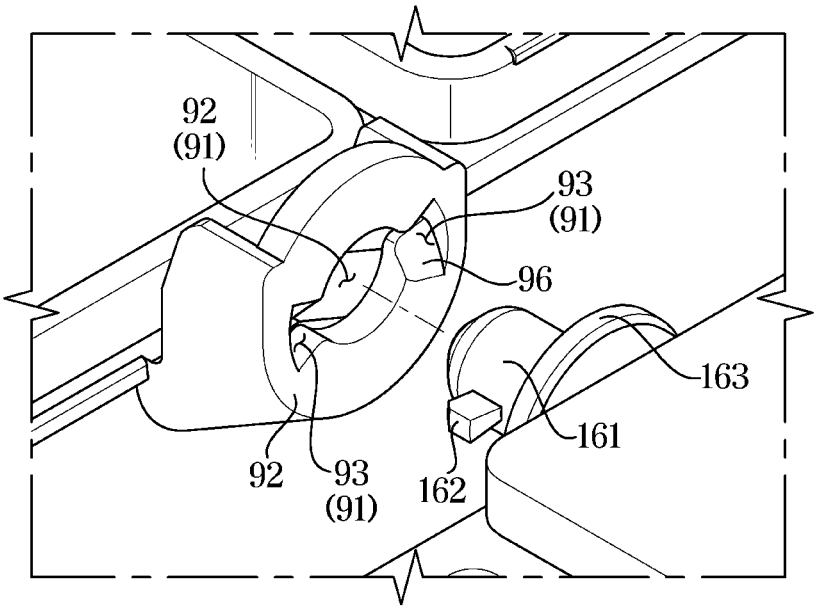
FIG. 13 is a view illustrating a process of a push connection being coupled to a detergent box according to an embodiment of the disclosure.

FIG. 10 is a view illustrating a detergent box connection according to an embodiment of the disclosure. FIG. 11 is a view illustrating a state in which a push connection is coupled to a detergent box while in a first position according to an embodiment of the disclosure. FIG. 12 is a view illustrating a state in which a push connection is released from a detergent box while in a second position according to an embodiment of the disclosure. FIG. 13 is a view illustrating a process of a push connection being coupled to a detergent box according to an embodiment of the disclosure.

The detergent box connection 90 may include a through hole 91. The through hole 91 may include a central hole 92 through which the header 161 passes and a locking hole 93 through which the locking protrusion 162 passes. The central hole 92 may be provided to correspond to the shape of the header 161, and the locking hole 93 may be provided to correspond to the shape of the locking protrusion 162.

The locking hole 93 may extend from the central hole 92. The locking hole 93 may be provided on the side of the central hole 92. The central hole 92 and the locking hole 93 may be connected to each other.

The detergent box connection 90 may include a support plate 94. The support plate 94 may be provided to form the through hole 91. The through hole 91 may be provided to pass through the support plate 94.

The support plate 94 may include a support surface 95. The support surface 95 may be the front surface of the support plate 94. The support surface 95 may be disposed to face the case opening 72.

Referring to FIG. 11, the push connection 150 may be coupled to the detergent box 80 in the first position A. The header 161 is inserted into the through hole 91, and the locking protrusion 162 is inserted into the locking hole 93 and then rotated to the first position A to thereby be supported on the support plate 94. The locking protrusion 162 may be in contact with the support surface 95 of the support plate 94.

In the first position A, the locking protrusion 162 is supported by the support plate 94, so that the push connection 150 may support the detergent box 80 in the mounting direction −X. Therefore, the detergent box 80 may be prevented from being separated from the electric module 100.

That is, the detergent box 80 may be prevented from being separated from the case 70. The detergent box 80 may be prevented from being separated from the case 70 due to vibration during operation of the washing machine 1.

Referring to FIG. 12, the push connection 150 may be rotated to the second position B and released from the detergent box 80. The locking protrusion 162 may be rotated to match the position of the locking hole 93.

In the second position B, the locking protrusion 162 may pass through the locking hole 93, so that the push connection 150 may move in the mounting direction −X and pass through the through hole 91, thereby achieving separation from the detergent box 80.

That is, since the detergent box 80 is separated from the electric module 100, the user may move the detergent box 80 to a desired position in the separating direction +X. For example, the user may completely separate the detergent box 80 from the case 70 and easily perform processes, such as washing the detergent box 80 or adding detergent.

Meanwhile, referring to FIG. 13, the detergent box connection 90 may include a coupling guide surface 96. The coupling guide surface 96 may be provided to guide the push connection 150 to be coupled to the through hole 91.

The coupling guide surface 96 may guide the position of the locking protrusion 162 such that the push connection 150 may pass through the through hole 91, that is, the locking protrusion 162 may pass through the locking hole 93. The coupling guide surface 96 may allow the push connection 150 to rotate such that the locking protrusion 162 may pass through the locking hole 93.

The coupling guide surface 96 may guide the push connection 150 to rotate from the first position A to the second position B. The coupling guide surface 96 may guide the locking protrusion 162 of the push connection 150 to rotate to the second position B and pass through the locking hole 93.

The coupling guide surface 96 may be disposed adjacent to the locking hole 93. The coupling guide surface 96 may be formed to protrude from the support plate 94.

The coupling guide surface 96 may include an inclined surface. The coupling guide surface 96 may include a curved surface.

Figure 14:
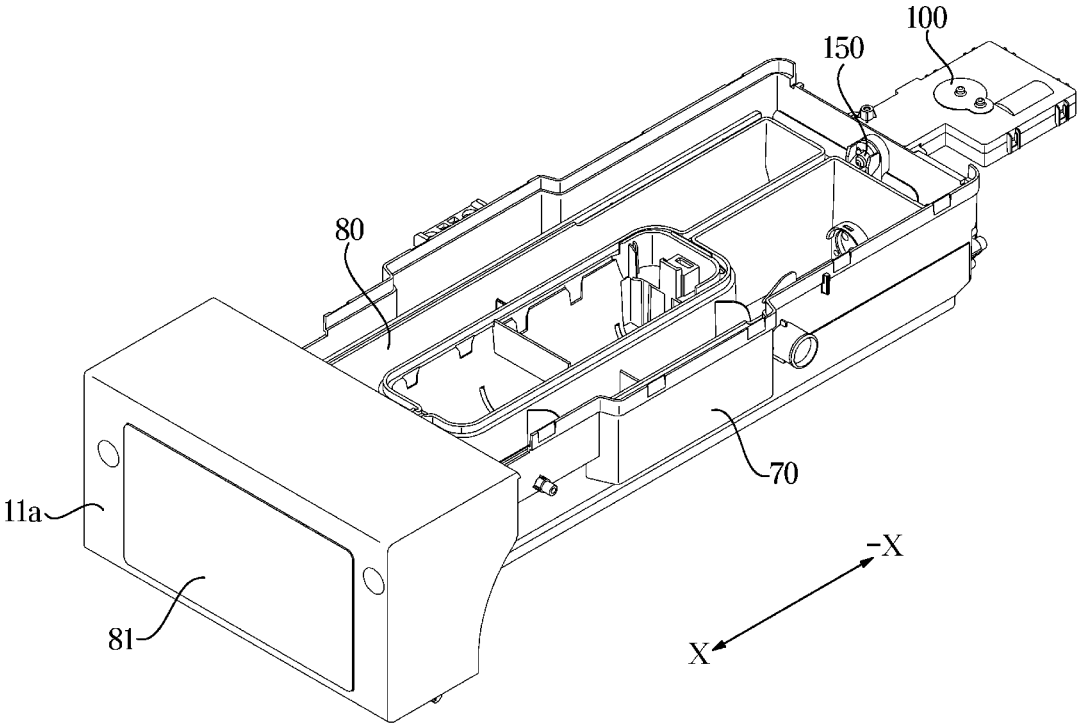
FIG. 14 is a view illustrating a state in which a detergent box is completely mounted inside a case during an operation of a detergent supply according to an embodiment of the disclosure.
Figure 15:
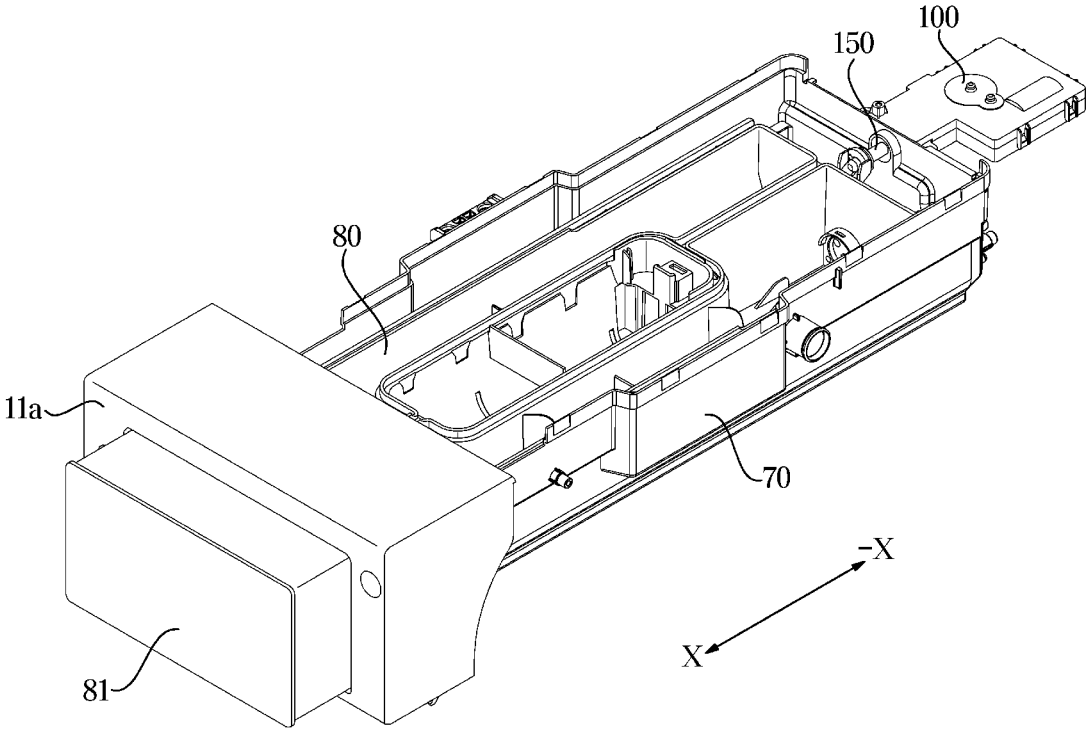
FIG. 15 is a view illustrating a process of a detergent box being separated from a case during an operation of a detergent supply according to an embodiment of the disclosure.
Figure 16:
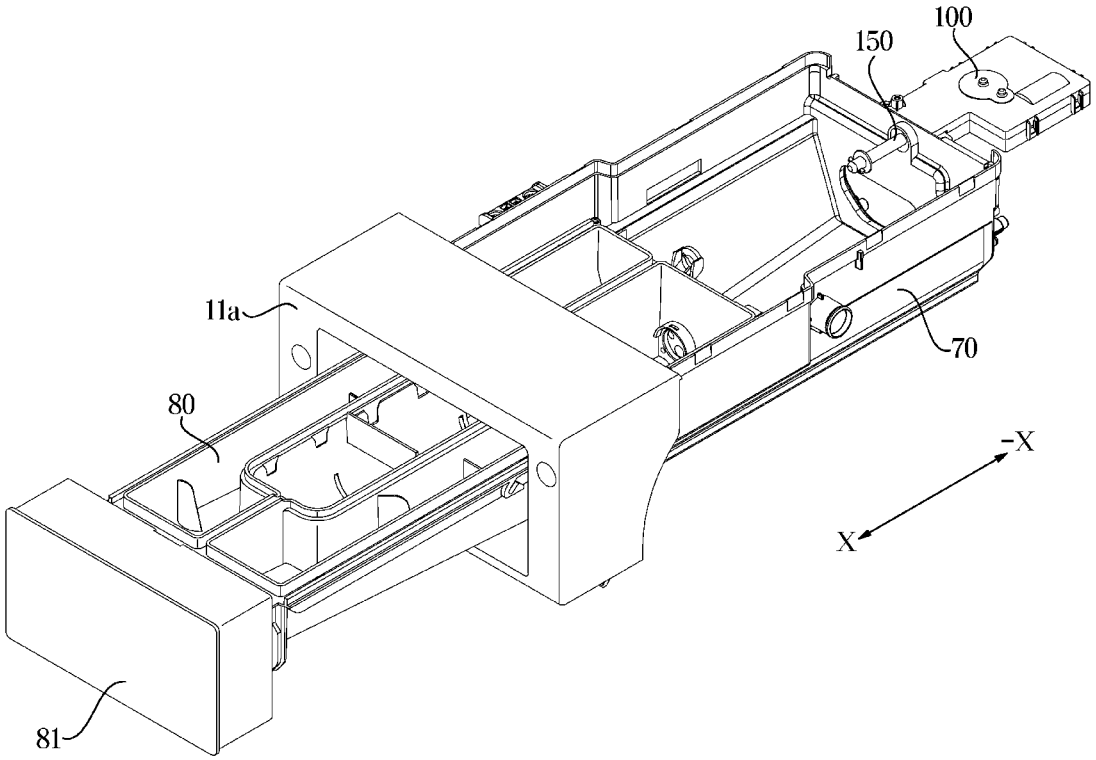
FIG. 16 is a view illustrating a state in which a detergent box has been separated from an electric module during an operation of a detergent supply according to an embodiment of the disclosure.
Figure 17:
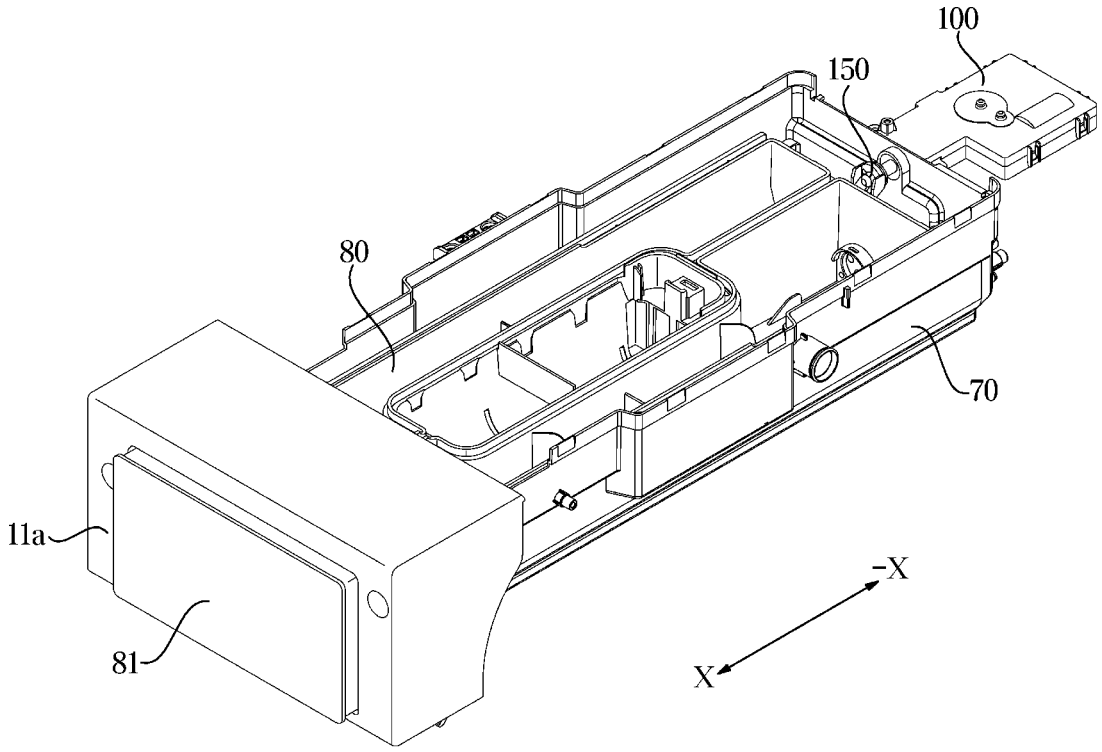
FIG. 17 is a view illustrating a process of a detergent box being mounted to a case during an operation of a detergent supply according to an embodiment of the disclosure.
Figure 18:
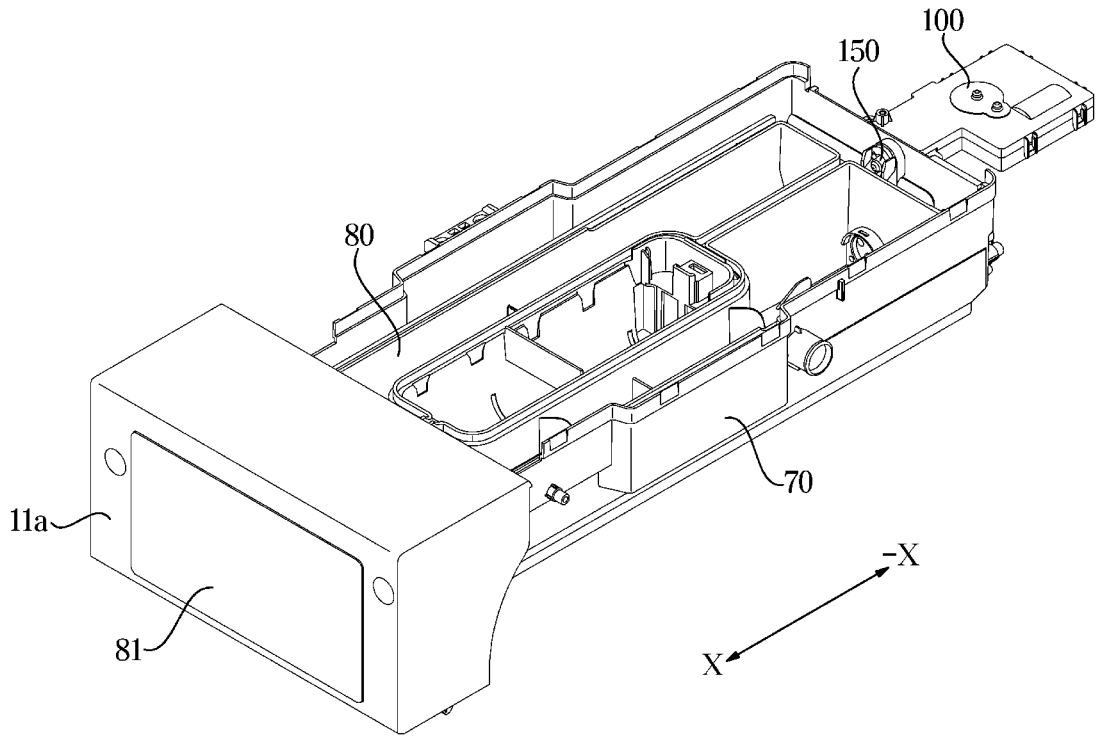
FIG. 18 is a view illustrating a state in which a detergent box has been mounted to a case during an operation of a detergent supply according to an embodiment of the disclosure.

FIG. 14 is a view illustrating a state in which a detergent box is completely mounted inside a case during an operation of a detergent supply according to an embodiment of the disclosure. FIG. 15 is a view illustrating a process of a detergent box being separated from a case during an operation of a detergent supply according to an embodiment of the disclosure. FIG. 16 is a view illustrating a state in which a detergent box has been separated from an electric module during an operation of a detergent supply according to an embodiment of the disclosure. FIG. 17 is a view illustrating a process of a detergent box being mounted to a case during an operation of a detergent supply according to an embodiment of the disclosure. FIG. 18 is a view illustrating a state in which a detergent box has been mounted to a case during an operation of a detergent supply according to an embodiment of the disclosure.

Referring to FIG. 14, the detergent box 80 may be in a closed state. The closed state may refer to a state in which the detergent box 80 is located at the rearmost most in the mounting direction −X and completely mounted inside the case 70.

When the detergent box 80 is in a closed state, detergent contained inside the detergent box 80 may be discharged toward the tub 20.

The push connection 150 may be located in the first pressing position.

The detergent box 80 may be in a state of being coupled to the push connection 150. The push connection 150 of the first position may be in a state of being coupled to the detergent box 80. Therefore, even when vibration is applied due to the operation of the washing machine 1, the detergent box 80 may be prevented from being separated from the case 70, thereby preventing detergent, and the like from leaking.

Referring to FIG. 15, the user may input a command to the washing machine 1 to open the detergent box 80. For example, the user may press the input button 12*a* provided on the control panel 12.

An open state may refer to a state in which the detergent box 80 is moved in the separating direction +X and protrudes outwardly from the front plate 11. The user may perform processes, such as checking the remaining amount of detergent contained in the detergent box 80 or replenishing detergent while the detergent box 80 is open.

The push connection 150 may apply a force to the detergent box 80 while moving toward the separating direction +X. The detergent box 80 may be moved in the separating direction +X by the push connection 150.

The push connection 150 may move from the first pressing position to the second pressing position. In this case, the push connection 150 may rotate from the first position to the second position.

Referring to FIG. 16, the push connection 150 moved to the second pressing position may be rotated to the second position. Accordingly, the coupling between the detergent box 80 and the push connection 150 may be released.

In this case, the user may manually move the detergent box 80 toward the separating direction +X. That is, since the coupling between the detergent box 80 and the push connection 150 is released, the user may additionally move the detergent box 80 toward the separating direction +X. For example, the user may completely separate the detergent box 80 from the case 70. The user may easily perform a desired process, such as washing the detergent box 80 separated from the washing machine 1.

Meanwhile, the push connection 150 in the second pressing position may be moved to a third pressing position located between the first pressing position and the second pressing position after being released from the detergent box 80. The push connection 150 may be moved in the mounting direction −X to the third pressing position. The push connection 150 moved to the third pressing position may stop. This may be referred to as a standby state of the push connection 150.

The push connection 150 may, while moving from the second pressing position to the third pressing position, rotating from the second position to the first position. The push connection 150 stopped at the third pressing position may remain stopped in the first position.

Referring to FIG. 17, the user may move the detergent box 80 in the mounting direction −X. For example, the user may move the detergent box 80 to the inside of the case 70 by pressing the detergent box cover 81 of the detergent box 80 in the mounting direction −X.

In this case, the user may manually move the detergent box 80 up to a point at which the detergent box 80 contacts the push connection 150.

When the detergent box 80 collides with the push connection 150 located in the third pressing position, the push connection 150 set in in the first position may be rotated to the second position by the coupling guide surface 96 provided in the through hole 91 to thereby be inserted into the through hole 91.

Thereafter, the push connection 150 may rotate back to the first position due to the reaction force of the spring 128, and the locking protrusion 162 is supported by the support plate 94, so that the push connection 150 may be coupled to the detergent box 80.

Referring to FIG. 18, when it is detected that the push connection 150 is coupled to the detergent box 80, the push connection 150 may be moved toward the mounting direction −X. The push connection 150 may be moved to the first pressing position. That is, the detergent box 80 may be completely inserted into the case 70 and set into a closed state.

Figure 19:
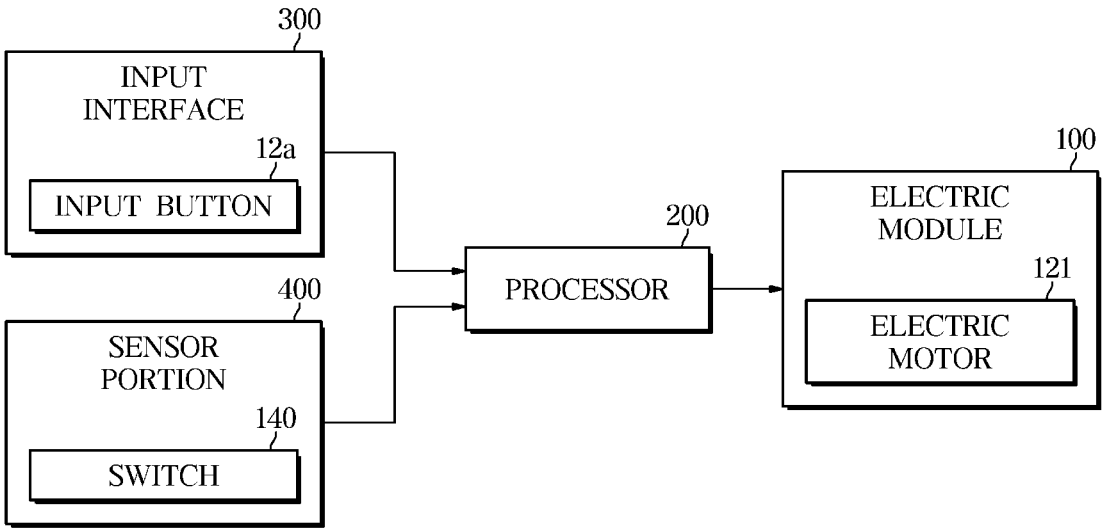
FIG. 19 is a functional block diagram of a washing machine according to an embodiment of the disclosure.

FIG. 19 is a functional block diagram of a washing machine according to an embodiment of the disclosure.

The washing machine 1 may include an input portion 300 (also referred to as an input interface), a sensor portion 400 (also referred to as a sensor), a control portion 200 (also referred to as a processor), and an electric module 100.

The input portion 300 may be provided to receive a user command such that the detergent box 80 is separated from the case 70. The input portion 300 may be provided to transmit the obtained information to the control portion 200.

The input portion 300 may include an input button 12*a*. However, the disclosure is not limited thereto, and the input portion 300 may be provided as a touch pad, dial, and the like. Alternatively, the input portion 300 may be provided on the outside of the washing machine 1. For example, the input portion 300 may be provided in a mobile phone.

The sensor 400 may be provided to detect the position of the push connection 150. The sensor 400 may be provided to detect the first pressing position, the second pressing position, and the third pressing position between which the push connection 150 moves along the one direction +X↔−X. The sensor 400 may be provided to detect a first position and a second position between which the push connection 150 rotates about an axis in the one direction +X↔−X.

The sensor 400 may be provided to transmit the obtained information to the control portion 200.

The sensor 400 may include a switch 140. However, the disclosure is not limited thereto, and the sensor 400 may be provided in various forms, such as a linear encoder and the like.

The control portion 200 may be provided to control the electric module 100 based on the information received from the input portion 300 and/or the sensor 400. The control portion 200 may be provided to control the operation of the electric motor 121. The control portion 200 may control the push connection 150 to move in one direction +X↔−X by driving the electric motor 121.

The electric motor 121 may allow the push connection 150 to move or stop by being driven or not driven. The electric motor 121 may allow the push connection 150 to move in the separating direction +X or the mounting direction −X depending on the rotation direction.

Figure 20:
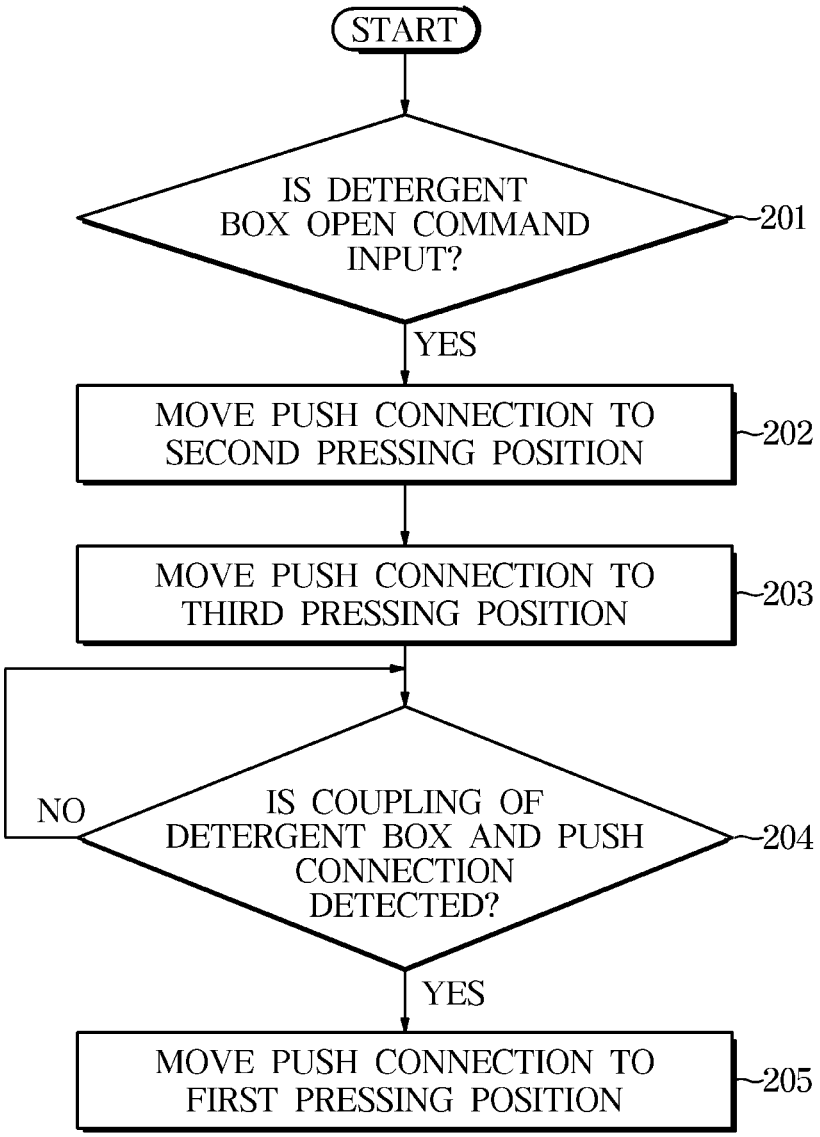
FIG. 20 is a flow chart showing a method of controlling a washing machine according to an embodiment of the disclosure.

FIG. 20 is a flow chart showing a method of controlling a washing machine according to an embodiment of the disclosure.

The input portion 300 may detect whether a detergent box open command has been input from the user. In response to a detergent box open command being input, the control portion 200 may control the electric motor 121 such that the push connection 150 moves to the second pressing position. In response to the push connection 150 being moved to the second pressing position and then the coupling between the push connection 150 and the detergent box 80 being released, the control portion 200 may control the electric motor 121 such that the push connection 150 moves to the third pressing position. Thereafter, the control portion 200 may control the electric motor 121 such that the push connection 150 moved to the third pressing position is stopped and set into in a standby state.

Afterwards, the user may move the detergent box 80 in the mounting direction −X such that the detergent box 80 may collide with the push connection 150. In this case, the push connection 150 may be rotated by the coupling guide surface 96 and coupled to the detergent box 80.

The sensor 400 may detect whether the push connection 150 is coupled to the detergent box 80. In response to the detergent box 80 and the push connection 150 being coupled to each other, the control portion 200 may control the electric motor 121 such that the push connection 150 moves to the first pressing position.

That is, in the case of mounting the detergent box 80 to the case 70, the user may need to manually move the detergent box 80 only to the third pressing position in which the push connection 150 is in standby, and then the push connection 150 and/or the detergent box 80 may be automatically moved toward the first pressing position by the control portion 200.

Meanwhile, in a process of the detergent box 80 being moved from the third pressing position to the first pressing position of the push connection 150, a repulsive force may be generated by docking between the detergent box 80 and the detergent pump. That is, in a process of moving the detergent box 80 in the mounting direction −X, the detergent box 80 may collide with components disposed at the rear, such as the detergent pump and the like, thus receiving a repulsive force in a direction opposite to the mounting direction −X.

In this case, since the detergent box 80 may be automatically moved by the push connection 150, the repulsive force may be prevented from being transmitted to the user. Therefore, convenience of use when mounting the detergent box 80 to the case 70 may be improved.

Figure 21:
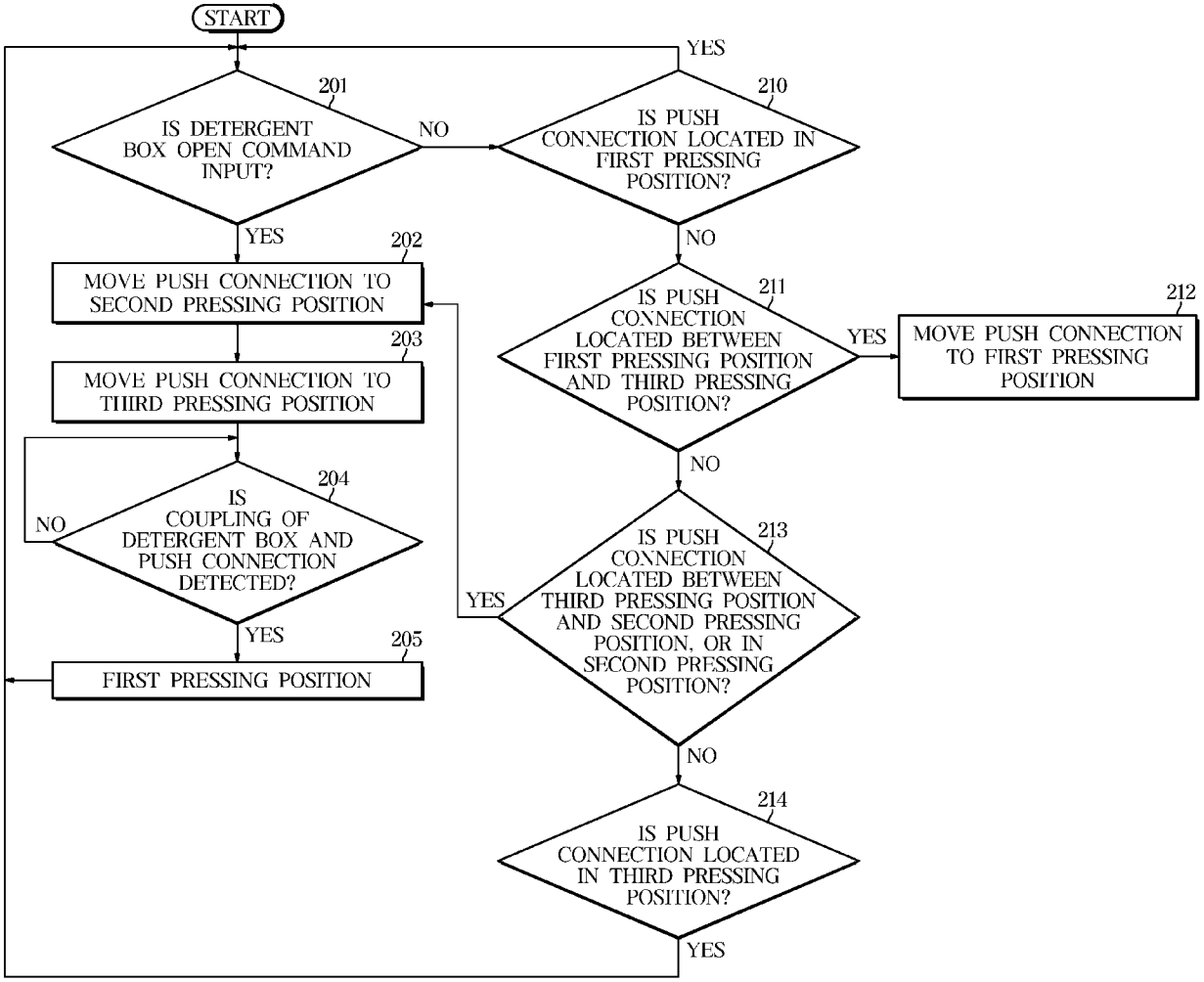
FIG. 21 is a flowchart showing a method of controlling a washing machine according to an embodiment of the disclosure.

FIG. 21 is a flowchart showing a method of controlling a washing machine according to an embodiment of the disclosure.

Descriptions identical to those of FIG. 20 are omitted.

In response to an absence of a detergent box open command being input, the sensor 400 may detect whether the push connection 150 is located in the first pressing position (210). Upon detecting that the push connection 150 is located in the first pressing position, it may be identified whether a detergent box open command is input to the input portion 300.

Upon detecting that the push connection 150 is not located in the first pressing position, the sensor 400 may detect whether the push connection 150 is located between the first pressing position and the third pressing position (211). Upon detecting that the push connection 150 is located between the first pressing position and the third pressing position, the control portion 200 may identify that the push connection 150 is not located in the correct position, and control the electric motor 121 to move the push connection 150 to the first pressing position (212).

Upon detecting that the push connection 150 is not located between the first pressing position and the third pressing position, the sensor 400 may detect whether the push connection 150 is located between the third pressing position and the second pressing position, or in the second pressing position (213).

Upon detecting that the push connection 150 is located between the third pressing position and the second pressing position, the control portion 200 may identify that the push connection 150 has stopped due to a power outage or the like in a process of moving to the second pressing position, and control the electric motor 121 to move the push connection 150 to the second pressing position (202). Alternatively, even upon detecting that the push connection 150 is located in the second pressing position, the control portion 200 may control the push connection 150 to remain in the second pressing position (202).

Upon detecting that the push connection 150 is neither located between the third pressing position and the second pressing position nor in the second pressing position, the sensor 400 may detect whether the push connection 150 is located in the third pressing position (214).

Upon detecting that the push connection 150 is located in the third pressing position, the control portion 200 may control the push connection 150 to maintain the third pressing position.

Figure 22:
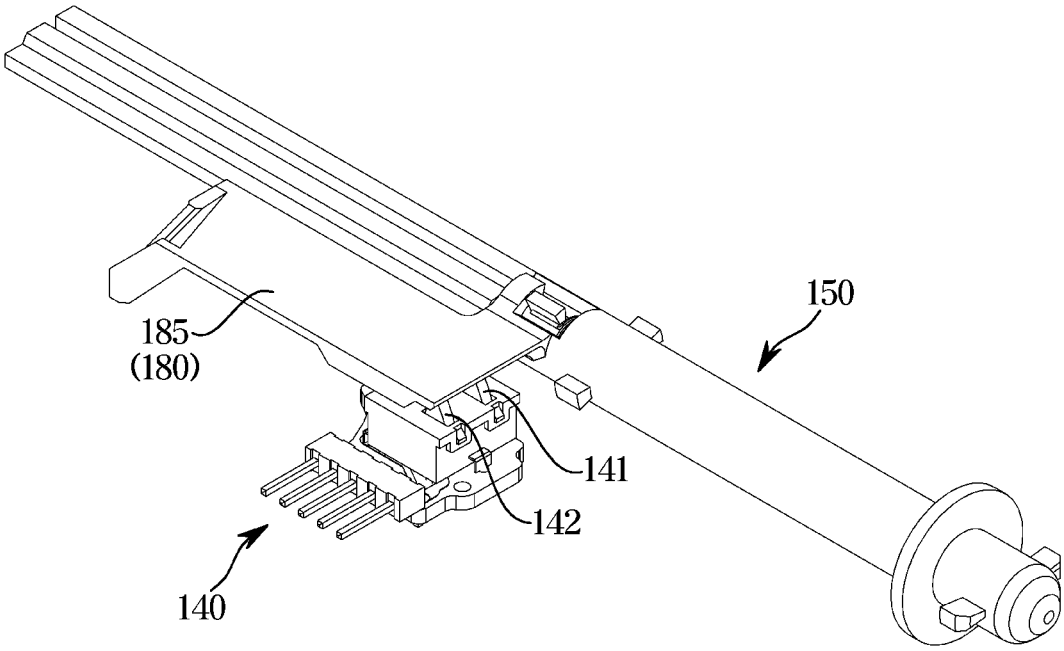
FIG. 22 is a perspective view illustrating the arrangement of a push connection and a switch according to an embodiment of the disclosure.

FIG. 22 is a perspective view illustrating the arrangement of a push connection and a switch according to an embodiment of the disclosure.

The switch contact 180 of the push connection 150 may be disposed to press the switch 140. The inner button 141 and/or the outer button 142 of the switch 140 may be selectively opened and closed by the wing 185.

Hereinafter, for convenience of description, when the inner button 141 and/or the outer button 142 is pressed, it may be referred to as being "closed," and when the inner button 141 and/or the outer button 142 is not pressed, it may be referred to as being "opened."

Figure 23:
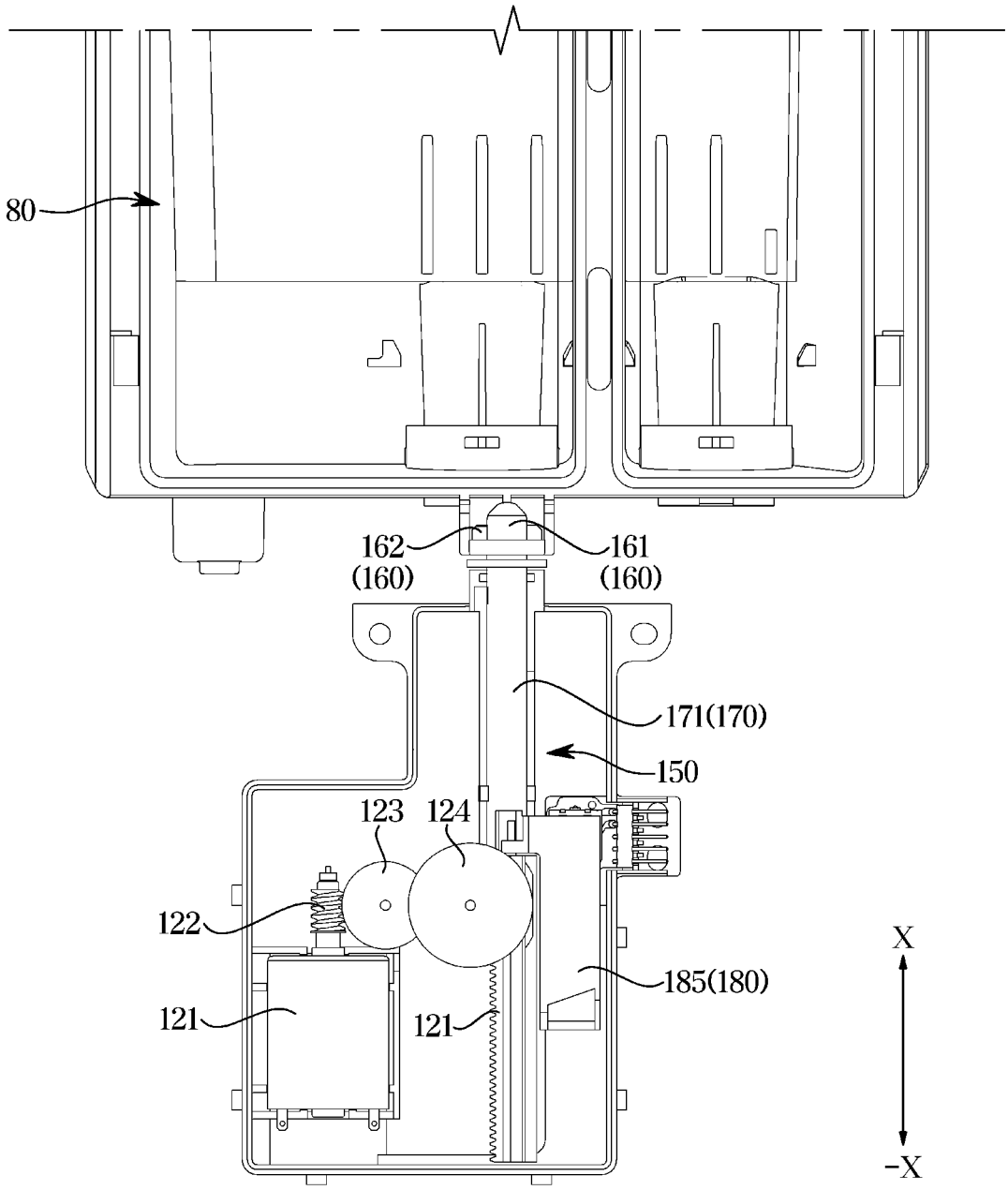
FIG. 23 is a view illustrating a movement process of a push connection.
Figure 24:
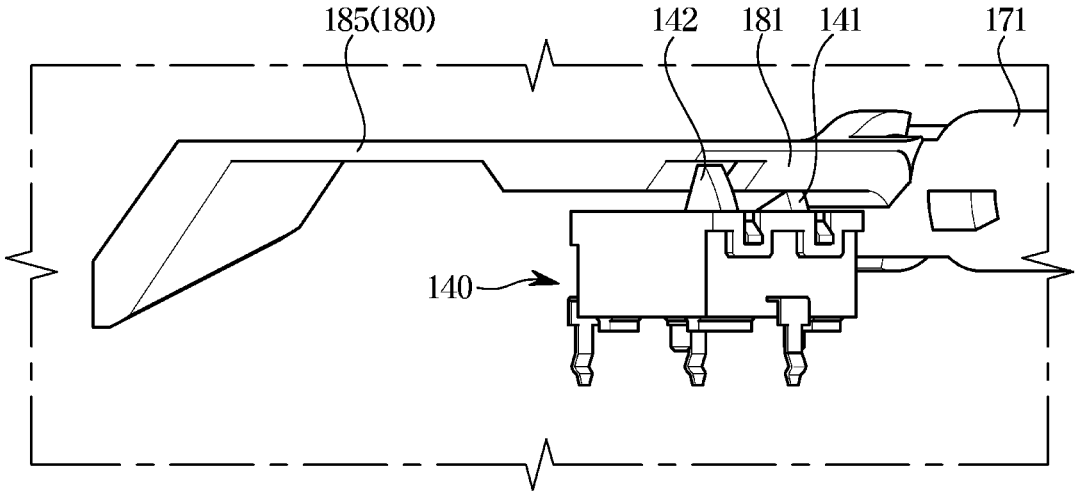
FIG. 24 is a view illustrating a switch shown in FIG. 23.

FIG. 23 is a view illustrating a movement process of a push connection. FIG. 24 is a view illustrating a switch shown in FIG. 23.

Referring to FIG. 23, the push connection 150 may be located in the first pressing position. In this case, referring to FIG. 24, the push connection 150 may be positioned such that the first pressing portion 181 presses the switch 140. The first pressing portion 181 may close the inner button 141 of the switch 140 while opening the outer button 142. The switch 140 may detect that the push connection 150 is in the first pressed position based on the inner button 141 being closed and the outer button 142 being opened.

Figure 25:
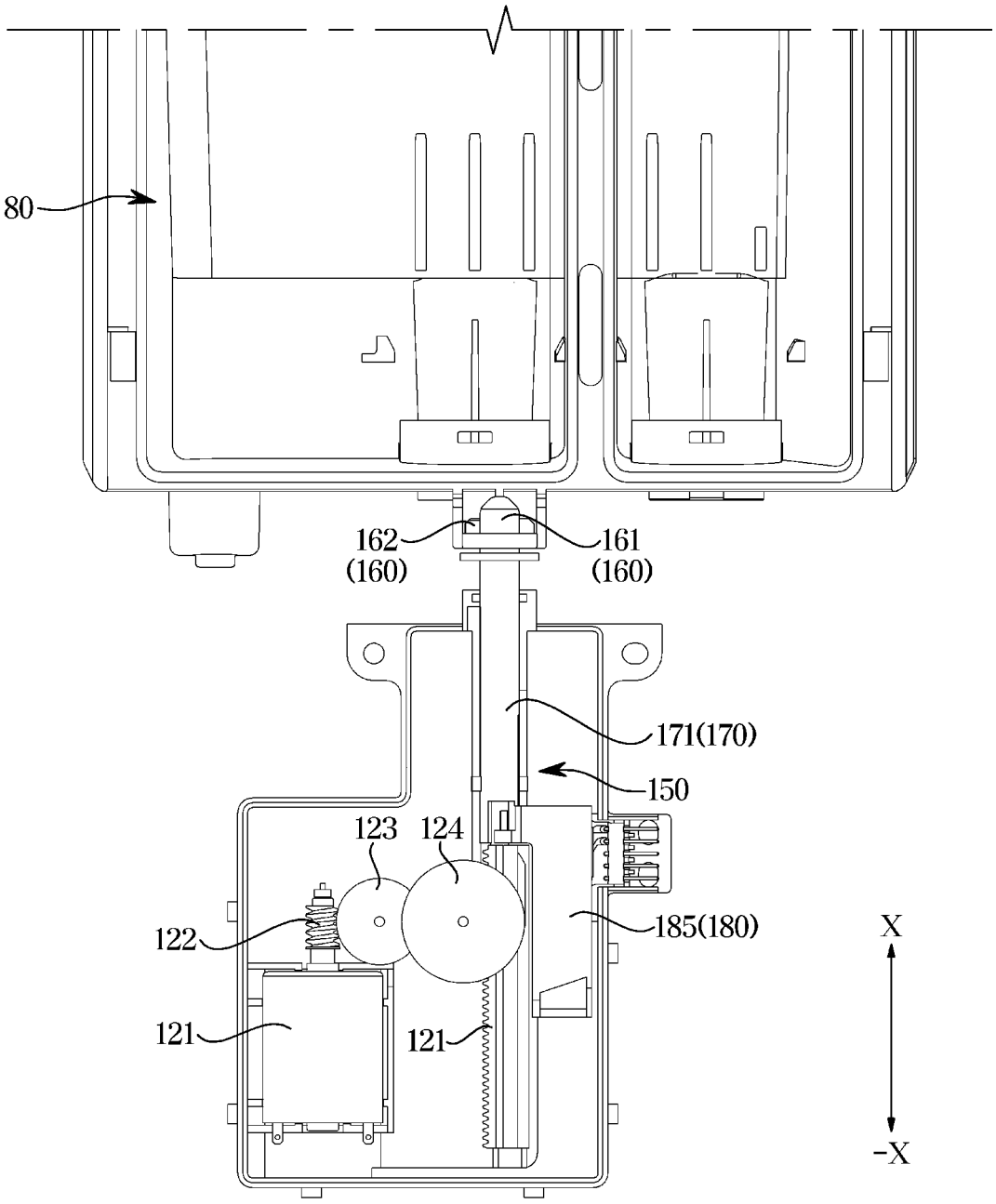
FIG. 25 is a view illustrating a movement process of a push connection.
Figure 26:
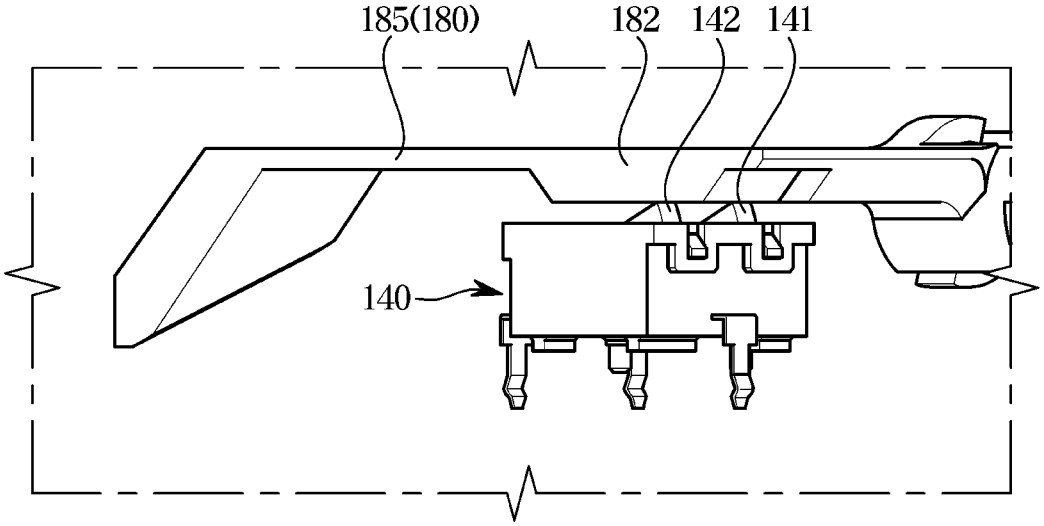
FIG. 26 is a view illustrating a switch shown in FIG. 25.

FIG. 25 is a view illustrating a movement process of a push connection. FIG. 26 is a view illustrating a switch shown in FIG. 25.

Referring to FIG. 25, the push connection 150 may move toward the separating direction +X from the first pressing position. In this case, referring to FIG. 26, the push connection 150 may be positioned such that the second pressing portion 182 presses the switch 140. The second pressing portion 182 may close the inner button 141 and the outer button 142 of the switch 140. The switch 140 may detect that the push connection 150 is located between the first pressing position and the third pressing position based on the inner button 141 and the outer button 142 being closed.

Figure 27:
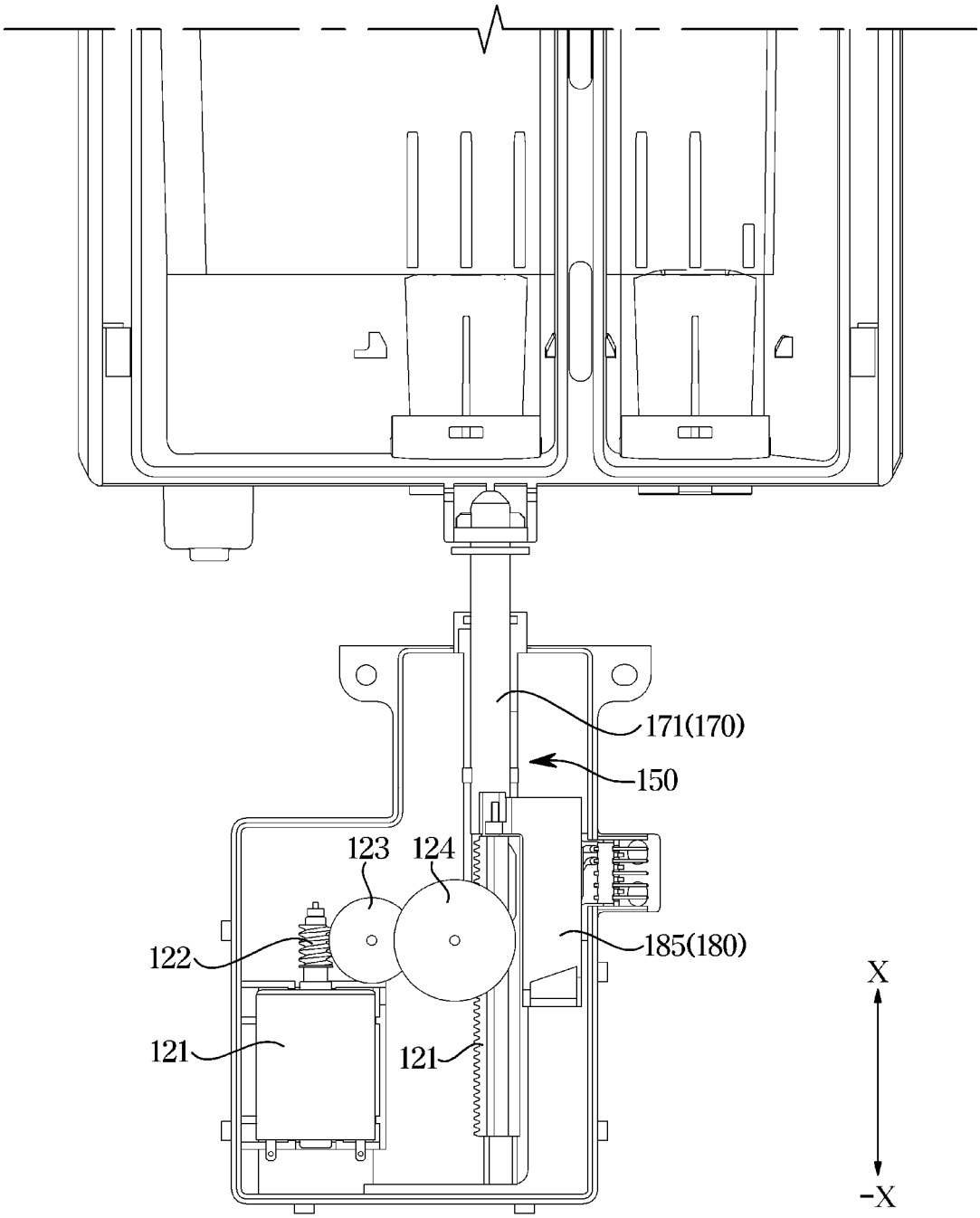
FIG. 27 is a view illustrating a movement process of a push connection.
Figure 28:
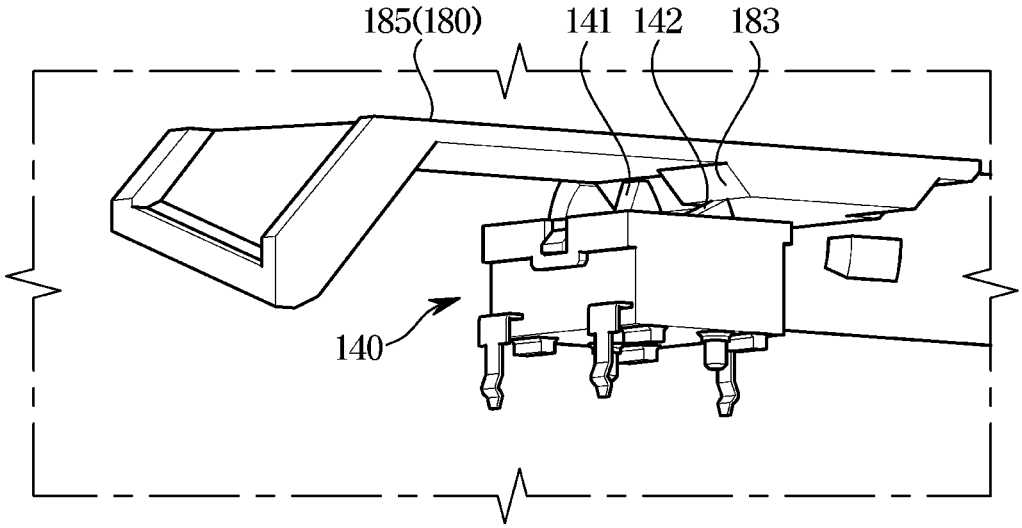
FIG. 28 is a view illustrating a switch shown in FIG. 27.

FIG. 27 is a view illustrating a movement process of a push connection. FIG. 28 is a view illustrating a switch shown in FIG. 27.

Referring to FIG. 27, the push connection 150 may be located in the third pressing position. In this case, referring to FIG. 28, the push connection 150 may be positioned such that the third pressing portion 183 presses the switch 140. The third pressing portion 183 may open the inner button 141 while closing the outer button 142 of the switch 140. The switch 140 may detect that the push connection 150 is located in the third pressing position based on the inner button 141 being opened and the outer button 142 being closed.

Figure 29:
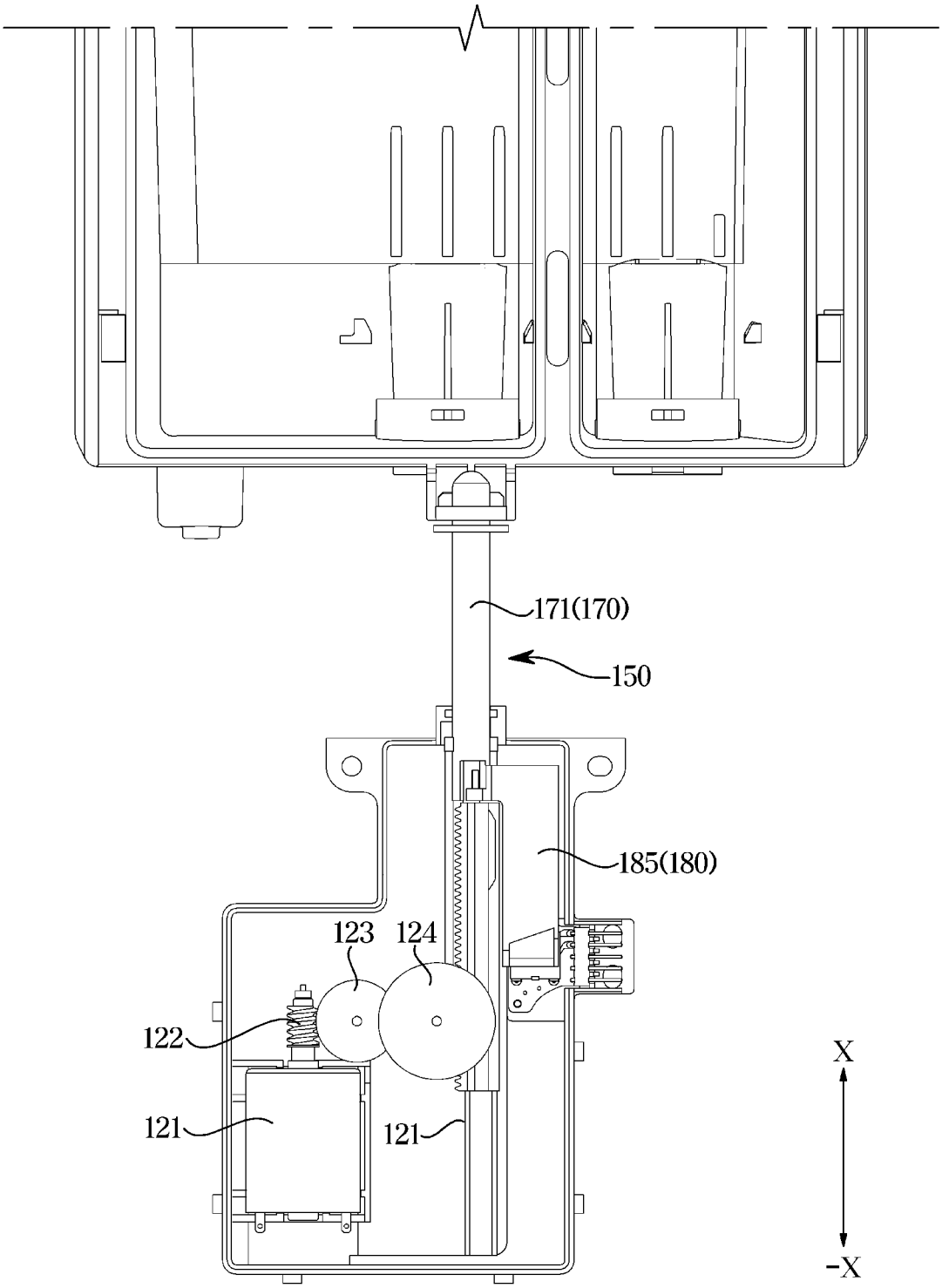
FIG. 29 is a view illustrating a movement process of a push connection.
Figure 30:
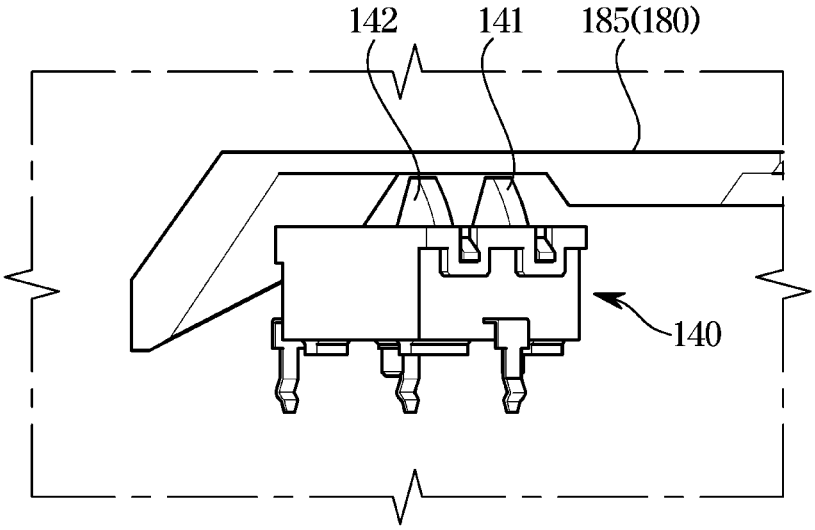
FIG. 30 is a view illustrating a switch shown in FIG. 29.

FIG. 29 is a view illustrating a movement process of a push connection. FIG. 30 is a view illustrating a switch shown in FIG. 29.

Referring to FIG. 29, the push connection 150 may move toward the separating direction +X from the third pressing position. In this case, referring to FIG. 30, the push connection 150 may be positioned not to press the switch 140. As a portion disposed between the third pressing portion 183 and the fourth pressing portion 184 of the push connection 150 is located at a position corresponding to the switch 140, the switch 140 may not be pressed. The switch 140 may detect that the push connection 150 is located between the third pressing position and the second pressing position based on the inner button 141 and the outer button 142 being opened.

Figure 31:
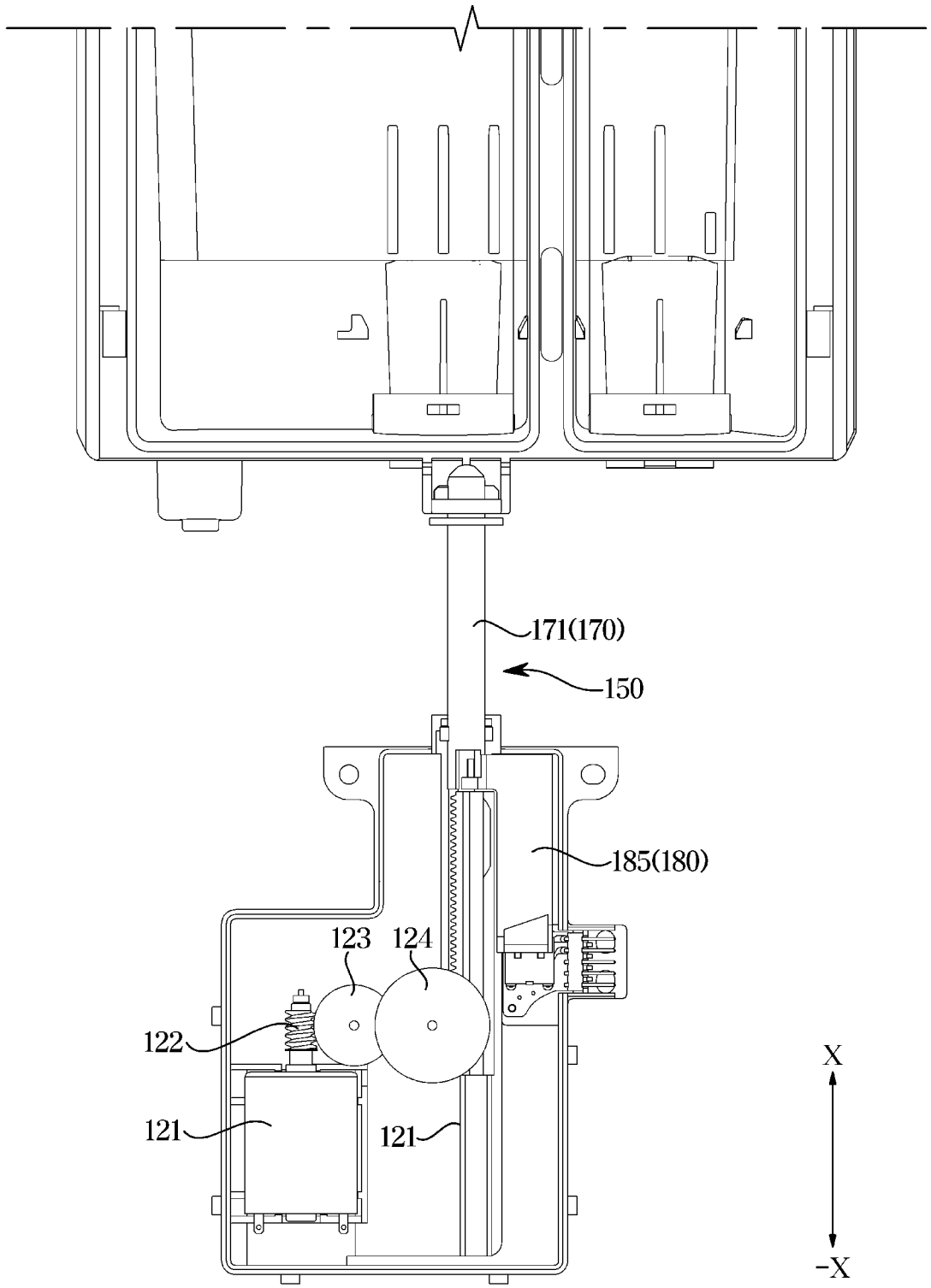
FIG. 31 is a view illustrating a movement process of a push connection.
Figure 32:
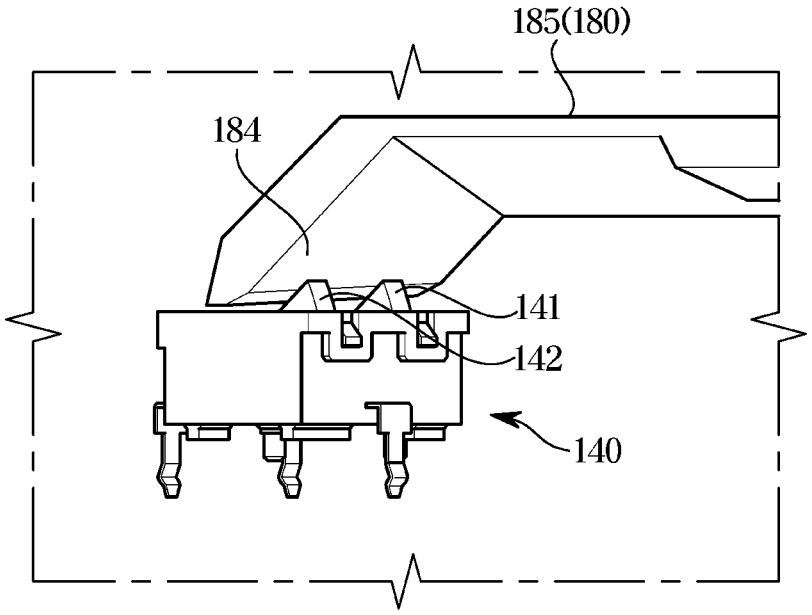
FIG. 32 is a view illustrating a switch shown in FIG. 31.

FIG. 31 is a view illustrating a movement process of a push connection. FIG. 32 is a view illustrating a switch shown in FIG. 31.

Referring to FIG. 31, the push connection 150 may be located in the second pressing position. In this case, referring to FIG. 32, the push connection 150 may be positioned such that the fourth pressing portion 184 presses the switch 140. The fourth pressing portion 184 may close the inner button 141 and the outer button 142 of the switch 140. The switch 140 may detect that the push connection 150 is located in the second pressing position based on the inner button 141 and the outer button 142 being closed.

Specifically, the switch 140 may detect that the push connection 150 is in the second pressing position by detecting that the inner button 141 and the outer button 142 opened in FIGS. 29 and 30 are closed as in FIGS. 31 and 32.

Figure 33:
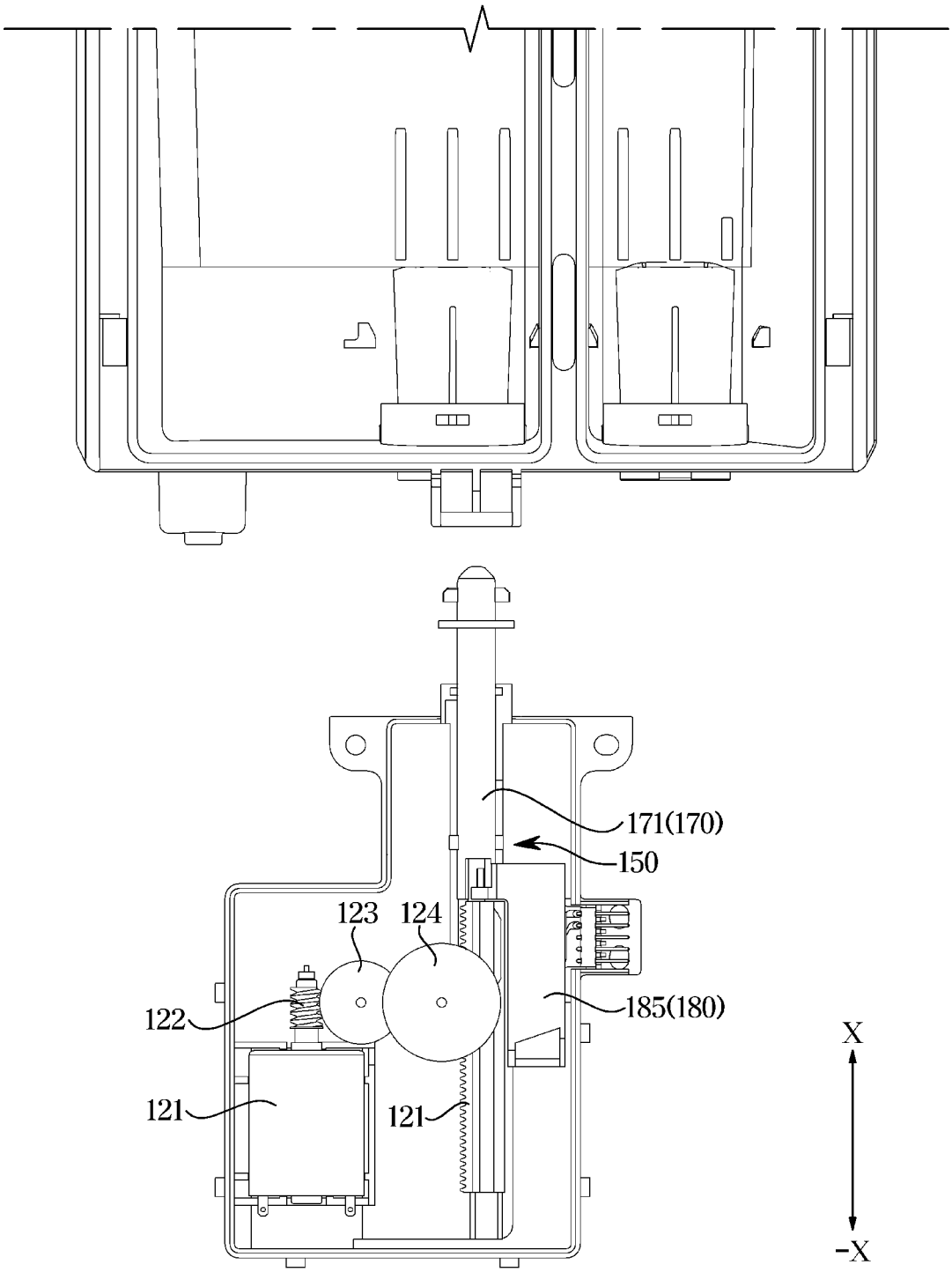
FIG. 33 is a view illustrating a movement process of a push connection.
Figure 34:
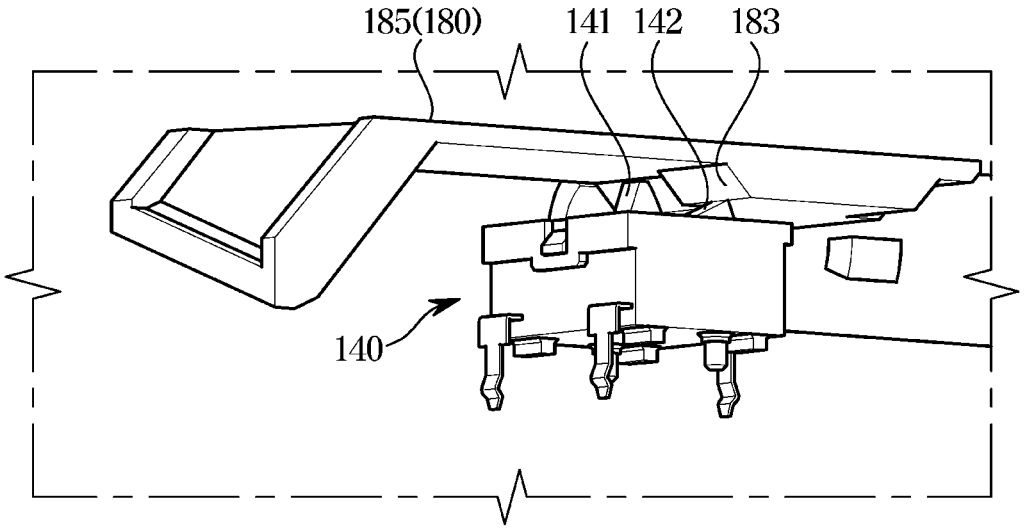
FIG. 34 is a view illustrating a switch shown in FIG. 33.

FIG. 33 is a view illustrating a movement process of a push connection. FIG. 34 is a view illustrating a switch shown in FIG. 33.

Referring to FIG. 33, the push connection 150 may be moved from the second pressing position in the mounting direction −X into the third pressing position. In this case, referring to FIG. 34, the push connection 150 may be positioned such that the third pressing portion 183 presses the switch 140. The third pressing portion 183 may open the inner button 141 while closing the outer button 142 of the switch 140. The switch 140 may detect that the push connection 150 is located in the third pressing position based on the inner button 141 being opened and the outer button 142 being closed.

Specifically, the switch 140 may detect that the push connection 150 has moved from the second pressing position to the third pressing position by detecting that the inner button 141 and the outer button 142 closed as in FIGS. 31 and 32 are switched such that the inner button 141 is opened and the outer button 142 is closed in FIGS. 33 and 34. Therefore, the push connection 150 may be controlled to stop at the third pressing position and remain in a standby state. Meanwhile, in this case, the push connection 150 may be located in the first position.

Figure 35:
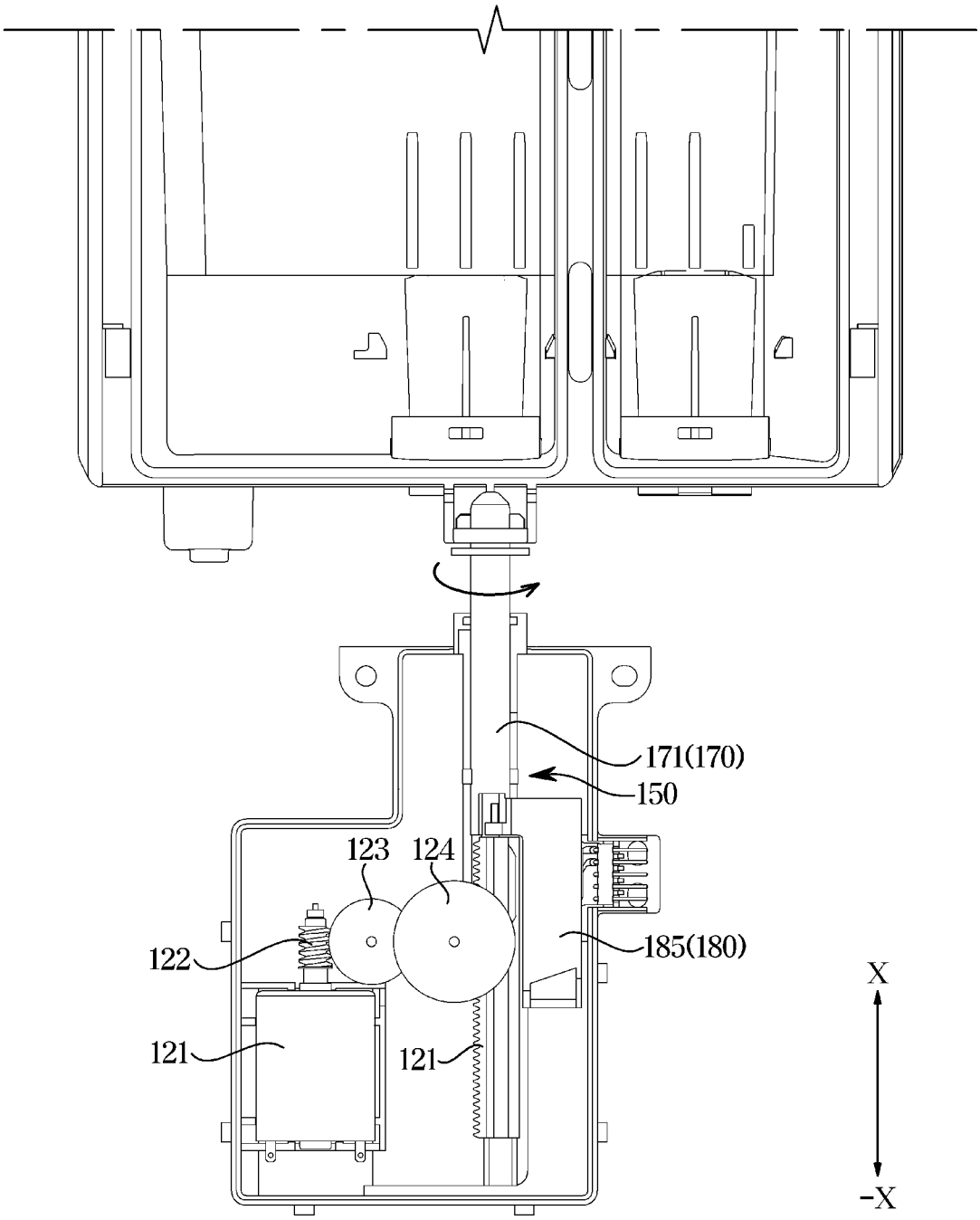
FIG. 35 is a view illustrating a movement process of a push connection.
Figure 36:
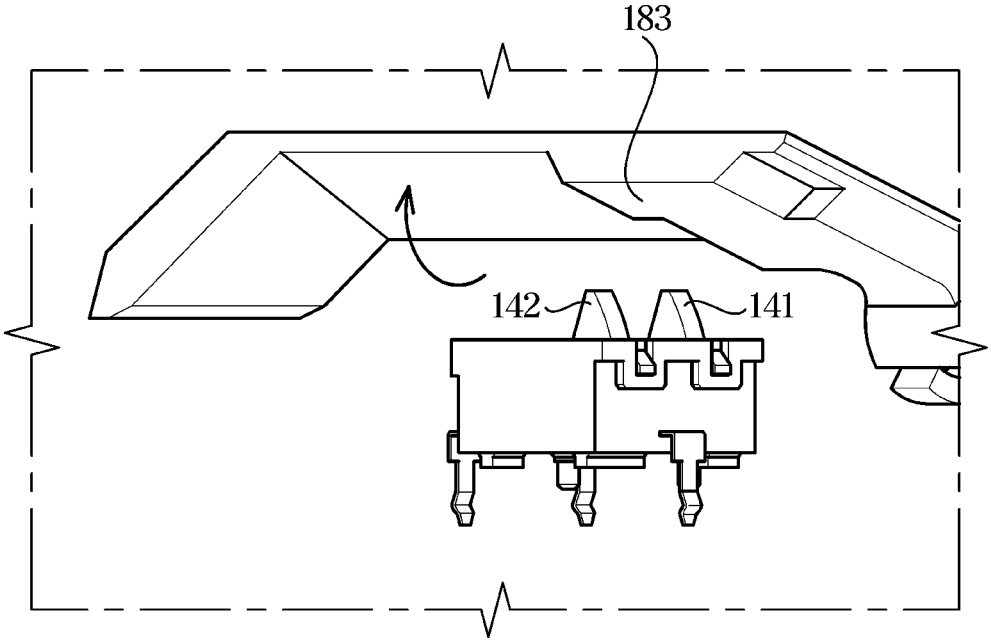
FIG. 36 is a view illustrating a switch shown in FIG. 35.

FIG. 35 is a view illustrating a movement process of a push connection. FIG. 36 is a view illustrating a switch shown in FIG. 35.

Referring to FIG. 35, the push connection 150 located in the third pressing position may collide with the detergent box 80. In this case, the push connection 150 may be rotated to the second position by the coupling guide surface 96 of the detergent box 80 and thus inserted into the through hole 91 of the detergent box 80. In this case, referring to FIG. 36, the push connection 150 may rotate to the second position, and thus the third pressing portion 183 may be rotated, causing the inner button 141 and the outer button 142 of the switch 140 to be opened.

Afterwards, the push connection 150 may be rotated back to the first position by the reaction force of the spring 128 and coupled to the detergent box 80. In this case, the third pressing portion 183 may be rotated to return to its original state, causing the inner button 141 of the switch 140 to be opened and the outer button 142 to be closed (FIG. 27 and FIG. 28).

That is, the switch 140 may detect that the push connection 150 rotates from the first position to the second position and then rotates back to the first position in response to a collision between the detergent box 80 and the push connection 150. Accordingly, the switch 140 may detect that the detergent box 80 and the push connection 150 are coupled to each other.

Thereafter, the push connection 150 may move from the third mounting position in the mounting direction −X to the first mounting position.

A washing machine 1 according to an embodiment includes: a housing 10; a tub 20 disposed inside the housing 10; and a detergent supply 50 configured to supply detergent to the tub, in which the detergent supply 50 includes: a case 70 mounted on the housing 10; a detergent box 80 configured to be movable in a mounting direction −X to be mounted on the case 70 and in a separating direction +X to be separated from the case; a push connection 150 configured to press onto the detergent box 80 in the separating direction +X, the push connection 150 being configured to be rotatable between a first position A in which the push connection 150 is coupled to the detergent box to support the detergent box 80 in the mounting direction −X and a second position B in which the push connection 150 is released from the detergent box 80 to release the supporting of detergent box 80 in the mounting position −X; and an electric motor 121 configured to allow the push connection 150 to operate. According to the disclosure, the push connection 150 may allow the detergent box 80 to move in the mounting direction −X and/or the separation direction +X by the electric motor 121, so that the detergent box 80 may be automatically mounted to and/or separated from the case 70, thereby increasing convenience of use. In addition, the push connection 150 may be coupled to the detergent box 80 in the first position A, thereby preventing the detergent box 80 from being separated from the case 70. The push connection 150 may be released from the detergent box 80 in the second position B, thereby facilitating processes, such as separating the detergent box 80 from the case 70 to wash the detergent box 80 or replenish detergent.

The push connection 150 may include a header 161 formed to extend toward the separating direction +X; and a locking protrusion 162 formed to extend from the header in a direction perpendicular to the separating direction +X to support the detergent box 80 in the first position A. The detergent box 80 may include: a support plate 94 configured to be in contact with the locking protrusion 162 to be supported by the locking protrusion 162 when the push connection 150 is in the first position A; and a through hole 91 formed in the support plate 94 to allow the locking protrusion 162 to pass therethrough when the push connection 150 is in the second position B. The through hole 91 may include: a central hole 92 through which the header 161 passes; and a locking hole 93 formed to extend from the central hole 92 and having a shape corresponding to a shape of the locking protrusion 162. According to the disclosure, since the locking protrusion 162 may be supported on the support plate 94, the detergent box 80 and the push connection 150 may be coupled to each other. Since the locking protrusion 162 may pass through the through hole 91, the coupling of the detergent box 80 and the push connection 150 may be released from each other.

The detergent box 80 may further include a coupling guide surface 96 adjacent to the locking hole 93 such that when the locking protrusion 162 is inserted into the locking hole 93, the locking protrusion 162 rotates from the second position B to the first position A. According to the disclosure, the push connection 150 may be easily inserted into the detergent box 80 by the coupling guide surface 96. In addition, the coupling guide surface 96 may guide the push connection 150 to rotate while being inserted into the detergent box 80, so that the sensor 400 may detect whether the detergent box 80 and the push connection 150 are coupled to each other according to the rotation of the push connection 150.

The washing machine 1 may further include a rotation guide configured to, when the push connection 150 moves in the separating direction +X, guide the push connection 150 to rotate from the first position A to the second position B. According to the disclosure, the push connection 150 may linearly move along one direction +X↔−X while rotating about an axis along one direction +X↔−X. That is, the push connection 150 may be coupled to or released from the detergent box 80 while moving the detergent box 80 in the separating direction +X and/or the mounting direction −X.

The rotation guide may include: a rotating protrusion 172 provided on the push connection 150 and formed to extend in a direction perpendicular to the separating direction +X; and a guide wall disposed adjacent to the push connection 150 and configured to seat the rotating protrusion 172 thereon. The guide wall 115 may include a contact surface 116 forming an upper surface to be in contact with the rotating protrusion 172, and the height of a first contact surface 116*a* configured to be in contact with the rotating protrusion 172 when the push connection 150 is in the first position A is different from the height of a second contact surface 116*b* configured to be in contact with the rotating protrusion 172 when the push connection 150 is in the second position. According to the disclosure, since the contact surface 116 has a varying height, rotation of the rotating protrusion 172 may be easily guided.

The washing machine 1 may further include: a sensor 400 configured to detect the position of the push connection 150 and generate a signal corresponding to the detection; and a control portion 200 configured to control the electric motor 121 by receiving the signal generated from the sensor 400. According to the disclosure, upon detecting, by the sensor 400, the position of the push connection 150, the push connection 150 may be moved by the control portion 200 without the user needing to manually move the detergent box 80, thereby automatically moving the detergent box 80. Accordingly, convenience of using the washing machine 1 may be improved.

The sensor 400 may include a switch 140 disposed adjacent to the push connection 150, and the push connection 150 may further include a switch contact 180 configured to open or close the switch 140 while the push connection 150 is moving in the separating direction +X. According to the disclosure, the push connection 150 may, while moving in one direction +X↔−X, press the switch 140, thereby easily detecting the movement of the push connection 150 in one direction +X↔−X.

The position in a direction +X of pressing the detergent box 80 by the push connection 150 coupled to the detergent box 80 in the first position A when the detergent box 80 is mounted on the case 70 is the first pressing position, the position in the direction +X of pressing the detergent box 80 by the push connection 150 when the detergent box 80 is rotated to the second position B is the second pressing position, and the control portion 200 may be configured to control the electric motor 121 for the push connection 150 to be movable between the first pressing position and the second pressing position. The washing machine 1 may further include an input portion 300 configured to, upon receiving a command to separate the detergent box 80 from the case 70, generate a signal corresponding to the received command, and the control portion 200 may be configured to, upon receiving a signal generated from the input portion 300, control the electric motor 121 to move the push connection 150 to the second pressing position and then to a third pressing position located between the first pressing position and the second pressing position. According to the disclosure, the push connection 150 automatically moves from the second pressing position to the third pressing position, thereby facilitating pressing of the detergent box 80 when the user moves the detergent box 80 in the mounting direction −X.

The sensor 400 may be configured to, upon detecting that the detergent box 80 is coupled to the push connection 150, generate a signal corresponding to the detection, and the control portion 200 may be configured to, upon receiving the signal generated from the sensor 400 400, control the electric motor 121 to move the push connection 150 from the third pressing position to the first pressing position. The sensor 400 may be provided to detect rotation of the push connection 150 from the first position A to the second position B when the push connection 150 is coupled to the detergent box 80. According to the disclosure, upon the push connection 150 being coupled to the detergent box 80, the push connection 150 may automatically move to the first pressing position, thereby preventing a repulsive force from being applied to the user in the separating direction +X.

A washing machine 1 according to an embodiment includes: a housing 10; a tub 20 disposed inside the housing 10; a case 70 mounted on the housing 10; a detergent box 80 configured to move in a mounting direction −X to be mounted on the case 70 and in a separating direction +X to be separated from the case; a push connection 150 coupleable to the detergent box 80 to press on the detergent box 80 in the separating direction +X; an electric motor 121 configured to operate the push connection 150; and a control portion 200 configured to control the electric motor 121, wherein the control portion 200 is configured to, upon the detergent box 80 being moved in the mounting direction −X and coupled to the push connection 150, control the electric motor 121 to move the push connection 150 in the mounting direction −X. According to the disclosure, since the push connection 150, upon being coupled to the detergent box 80, automatically moves in the mounting direction −X, a repulsive force may be prevented from being applied to the user in the separating direction +X.

The position in a direction +X of pressing the detergent box 80 by the push connection 150 coupled to the detergent box 80 in the first position A when the detergent box 80 is mounted on the case 70 is the first pressing position, the position in the direction +X of pressing the detergent box 80 by the push connection 150 when the detergent box 80 is rotated to the second position B is the second pressing position, and the control portion 200 may be configured to control the electric motor 121 for the push connection 150 to be movable between the first pressing position and the second pressing position. The washing machine 1 may further include an input portion 300 configured to, upon receiving a command to separate the detergent box 80 from the case 70, generate a signal corresponding to the received command, and the control portion 200 may be configured to, upon receiving the signal generated from the input portion 300, control the electric motor 121 to move the push connection 150 to the second pressing position and then to a third pressing position located between the first pressing position and the second pressing position. The washing machine 1 may further include a sensor 400 configured to detect that the detergent box 80 is coupled to the push connection 150 and generate a signal corresponding to the detection, and the control portion 200 may be configured to, upon receiving the signal generated from the sensor 400, control the electric motor 121 to move the push connection 150 from the third pressing position to the first pressing position. According to the disclosure, the user may, without needing to manually move the detergent box 80, input a command into the input portion 300 for the control portion 200 to move the push connection, thereby automatically moving the detergent box 80. Accordingly, the convenience of using the washing machine 1 may be improved.

A washing machine 1 according to an embodiment includes: a housing 10; a tub 20 disposed inside the housing 10; and a detergent supply 50 configured to supply detergent to the tub 20, in which the detergent supply 50 includes: a case 70 formed with an opening 72; a detergent box 80 configured to be movable in one direction +X↔−X with respect to the case 70 through the opening 72; and an electric module 100 coupleable to the detergent box 80 for the detergent box 80 to be movable in the one direction +X↔−X, wherein the electric module 100 includes an electric motor 121 and a push connection 150 configured to receive a driving force from the electric motor 121 and move in the one direction +X↔−X, the push connection 150 including a locking protrusion 162 configured to be inserted into the detergent box 80 and rotatable about an axis in the one direction +X↔−X, to prevent the push connection 150 from being separated from the detergent box 80. According to the disclosure, the push connection 150 may allow the detergent box 80 to move in one direction +X↔−X by the electric motor 121, so that the detergent box 80 may be automatically mounted to and/or separated from the case 70, thereby increasing the convenience of use. In addition, the locking protrusion 162 may be rotated and supported on the detergent box 80, thereby preventing the detergent box 80 from being separated from the case 70.

While the disclosure has been shown and described with reference to various embodiments thereof, it will be understood by those skilled in the art that various changes in form and details may be made therein without departing from the spirit and scope of the disclosure as defined by the appended claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a housing;

a tub disposed inside the housing; and a detergent supply configured to supply detergent to the tub, wherein the detergent supply includes:

a case mounted on the housing;

a detergent box configured to be movable in a mounting direction −X to be mounted on the case and in a separating direction +X to be separated from the case; and a push connection including a rotating shaft, the push connection configured to press onto the detergent box in the separating direction +X and be rotatable about the rotating shaft between a first position A in which the push connection is coupled to the detergent box to support the detergent box in the mounting direction −X and a second position B in which the push connection is released from the detergent box to release the supporting of the detergent box in the mounting direction −X; and an electric motor configured to operate the push connection.

2. The washing machine of claim 1, wherein the push connection includes a header formed to extend toward the separating direction +X; and a locking protrusion formed to extend from the header in a direction perpendicular to the separating direction +X to support the detergent box in the first position A.

3. The washing machine of claim 2, wherein the detergent box includes:

a support plate configured to be in contact with the locking protrusion to be supported by the locking protrusion when the push connection is in the first position A; and a through hole formed in the support plate to allow the locking protrusion to pass therethrough when the push connection is in the second position B.

4. The washing machine of claim 3, wherein the through hole includes:

a central hole through which the header passes; and a locking hole formed to extend from the central hole and having a shape corresponding to a shape of the locking protrusion.

5. The washing machine of claim 4, wherein the detergent box further includes a coupling guide surface adjacent to the locking hole such that when the locking protrusion is inserted into the locking hole, the locking protrusion is configured to rotate from the second position B to the first position A.

6. The washing machine of claim 1, further comprising a rotation guide configured to, when the push connection moves in the separating direction +X, guide the push connection to rotate from the first position A to the second position B.

7. The washing machine of claim 6, wherein the rotation guide includes:

a rotating protrusion provided on the push connection and formed to extend in a direction perpendicular to the separating direction +X; and a guide wall disposed adjacent to the push connection and configured to seat the rotating protrusion thereon.

8. The washing machine of claim 7, wherein the guide wall includes a contact surface forming an upper surface to be in contact with the rotating protrusion, wherein a height of a first contact surface configured to be in contact with the rotating protrusion when the push connection is in the first position is different from a height of a second contact surface configured to be in contact with the rotating protrusion when the push connection is in the second position.

9. The washing machine of claim 1, further comprising: a sensor configured to detect a position of the push connection and generate a signal corresponding to the detection; and a processor configured to control the electric motor by receiving the signal generated from the sensor.

10. The washing machine of claim 9, wherein the sensor includes a switch disposed adjacent to the push connection, wherein the push connection further includes a switch contact configured to open or close the switch while moving in the separating direction +X.

11. The washing machine of claim 9, wherein a position in a direction +X of pressing the detergent box by the push connection coupled to the detergent box in the first position A when the detergent box is mounted on the case is a first pressing position, a position in the direction +X of pressing the detergent box by the push connection when the detergent box is rotated to the second position B is a second pressing position, and the processor is configured to control the electric motor for the push connection to be movable between the first pressing position and the second pressing position.

12. The washing machine of claim 11, further comprising an input interface configured to, upon receiving a command to separate the detergent box from the case, generate a signal corresponding to the received command, wherein the processor is configured to, upon receiving a signal generated from the input interface, control the electric motor to move the push connection to the second pressing position and then to a third pressing position located between the first pressing position and the second pressing position.

13. The washing machine of claim 12, wherein the sensor is configured to, upon detecting that the detergent box is coupled to the push connection, generate a signal corresponding to the detection, and the processor is configured to, upon receiving the signal generated from the sensor, control the electric motor to move the push connection from the third pressing position to the first pressing position.

14. The washing machine of claim 13, wherein the sensor is configured to detect a rotation of the push connection from the first position A to the second position B when the push connection is coupled to the detergent box.

15. A washing machine comprising:

a housing;

a tub disposed inside the housing;

a case mounted on the housing;

a detergent box configured to be movable in a mounting direction −X to be mounted on the case and in a separating direction +X to be separated from the case;

a push connection including a rotating shaft, the push connection couplable to the detergent box to press on the detergent box in the separating direction +X and be rotatable about the rotating shaft between a first position and a second position to release a supporting of the detergent box in the mounting direction −X; and an electric motor configured to operate the push connection; and a processor configured to control the electric motor, wherein the processor is configured to, upon the detergent box being moved in the mounting direction −X and coupled to the push connection, control the electric motor to move the push connection in the mounting direction −X.

* * * * *